US010697181B2

(12) United States Patent
Arnold et al.

(10) Patent No.: US 10,697,181 B2
(45) **Date of Patent: *Jun. 30, 2020**

(54) EDGE METAL SYSTEM

(71) Applicant: Garland Industries, Inc., Cleveland, OH (US)

(72) Inventors: Kevin Arnold, Cumming, GA (US); Thomas G. Diamond, Cuyahoga Falls, OH (US); Randy Hensley, Blairsville, GA (US); George Jones, Johns Creek, GA (US); Travis Donald Lord, Cleveland, OH (US); Zachary Michael Wahl, Duluth, GA (US); Frank V. Resso, Newnan, GA (US)

(73) Assignee: Barnes Group Inc., Bristol, CT (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/250,297

(22) Filed: Jan. 17, 2019

(65) Prior Publication Data

US 2019/0145106 A1 May 16, 2019

Related U.S. Application Data

(63) Continuation of application No. 15/891,575, filed on Feb. 8, 2018, now Pat. No. 10,208,480, which is a continuation of application No. 15/434,460, filed on Feb. 16, 2017, now Pat. No. 10,087,636.

(51) Int. Cl.

| | |
|---|---|
| ***E04D 13/15*** | (2006.01) |
| ***E04D 13/158*** | (2006.01) |
| ***E04D 13/16*** | (2006.01) |

(52) U.S. Cl.
CPC ..... *E04D 13/158* (2013.01); *E04D 13/15* (2013.01); *E04D 13/1643* (2013.01)

(58) Field of Classification Search
CPC .... E04D 13/158; E04D 13/15; E04D 13/1643
See application file for complete search history.

(56) References Cited

U.S. PATENT DOCUMENTS 3,735,540 A * 5/1973 Thaler ..... E04D 13/155 52/94
3,862,531 A * 1/1975 Attaway ..... E04D 3/405 52/300
4,037,372 A * 7/1977 Patry ..... E04D 13/155 52/96
4,403,458 A * 9/1983 Lolley ..... E04D 13/155 52/60
4,404,777 A * 9/1983 Lolley ..... E04D 13/155 52/60
4,665,667 A * 5/1987 Taylor ..... E04D 13/155 52/96
4,707,954 A * 11/1987 Butzen ..... E04D 13/155 52/60
4,780,997 A * 11/1988 Taylor ..... E04D 13/15 52/96
4,780,999 A * 11/1988 Webb ..... E04D 13/155 52/60
4,800,689 A * 1/1989 Lane ..... E04D 13/155 52/60

(Continued)

*Primary Examiner* — Beth A Stephan
(74) *Attorney, Agent, or Firm* — Fay Sharpe LLP

(57) ABSTRACT

A roof edging system that includes a base anchor, a fascia cover, and a compression system that is used to provide compression thereby, allowing the fascia cover to snap into place on the base anchor.

13 Claims, 11 Drawing Sheets

(56) References Cited

U.S. PATENT DOCUMENTS

| | | | | | |
|---|---|---|---|---|---|
| 4,858,406 | A * | 8/1989 | Lane | E04D 3/405 | 52/300 |
| 4,970,832 | A * | 11/1990 | van Herpen | E04D 13/15 | 52/60 |
| 5,239,791 | A * | 8/1993 | Mills, Jr. | E04D 3/405 | 52/300 |
| 5,927,023 | A * | 7/1999 | Kittilstad | E04D 13/155 | 52/60 |
| 6,578,322 | B2 * | 6/2003 | Kintop | E04D 13/155 | 52/300 |
| 6,786,018 | B2 * | 9/2004 | Webb | E04D 3/405 | 52/300 |
| 6,845,590 | B1 * | 1/2005 | Mills, Jr. | E04D 13/155 | 52/60 |
| 6,912,814 | B1 * | 7/2005 | Inzeo | E04D 3/405 | 52/300 |
| 7,451,572 | B1 * | 11/2008 | Inzeo | E04D 3/405 | 52/300 |
| 7,647,730 | B1 * | 1/2010 | Inzeo | E04D 13/155 | 52/300 |
| 7,748,173 | B1 * | 7/2010 | Inzeo | E04D 3/405 | 52/300 |
| 8,205,396 | B2 * | 6/2012 | Atiyeh, Sr. | E04D 13/155 | 52/300 |
| 8,959,853 | B2 * | 2/2015 | Bortell | E04D 13/0459 | 52/219 |
| 9,284,734 | B1 * | 3/2016 | Inzeo | E04D 13/0459 | |
| 2016/0168859 | A1 * | 6/2016 | Vargas | E04D 13/158 | 52/716.2 |

* cited by examiner

EDGE METAL SYSTEM

The present invention is a continuation of U.S. patent application Ser. No. 15/891,575 filed Feb. 8, 2018, which in turn is a continuation of U.S. patent application Ser. No. 15/434,460 filed Feb. 16, 2017 (now U.S. Pat. No. 10,087,636; issued Oct. 2, 2018), which is incorporated herein by reference.

The present invention relates to roof edging systems, particularly to a roof edging system that includes a compression system, and more particularly to a roof edging system that includes a compression system that is capable of compressing so as to allow a cap to engage a base anchor and be snapped or otherwise secured into place.

BACKGROUND ON THE INVENTION

Many types of building have flat roofs with exposed roof edges that must be sealed in order to prevent water from leaking into the interior of the building. The roofs on buildings of this type include adhered or mechanically attached single-ply roofs and built-up or modified roof systems, among others. In order to effectively seal the roofs of these buildings, many different roof edging systems, such as fascia covers and copings, have been developed which cooperate with a roofing membrane placed over the roof to prevent water from entering a building between the membrane and the remainder of the building.

Metal springs can be included in existing fascia systems. However, such metal springs can transfer too much tension to the face of the metal covering. As a result, the metal cover is morphed into a concave shape which appears similar to oil canning. Such an appearance is not aesthetically pleasing.

Non-limiting examples of prior art fascia systems are present in: U.S. Pat. Nos. 6,845,590; 6,912,814; 7,451,572; and 7,748,173, all of which are incorporated herein by reference.

In view of the prior art, there remains a need for a novel roof edging system that includes one or more components that can be used to improve the seat between the fascia cover and the underlying base anchor.

SUMMARY OF THE INVENTION

The present invention is directed to an improved roof edging system that includes the use of a compression system to provide suitable compression to allow the cap to engage the base anchor and "snap" into place. The compression system can include a member that is fully or partially formed of rubber, plastic, polyurethane, polyvinyl chloride (PVC), polyethylene, polystyrene, and/or other types of compressible polymer materials; however, this is not required.

In accordance with various non-limiting embodiments of the present invention, there is provided a roof edging system that can be connected to a building having a sidewall and a roof; however, this is not required. As can be appreciated, the roof edging system can be connected to a building and/or structure absent a roof. Generally, the roof of a building includes multiple layers, such as, for example, a metal deck, insulation, base ply, a roofing membrane, etc. A bracket is typically used to support the one or more components of the roof at or near the sidewall, and a fastener (e.g., bolt, screw, nail, clip, etc.) is used to secure the bracket to the sidewall. However, other or alternative connection means can be used (e.g., adhesives, welding, etc.). A roofing membrane (when used) typically covers one or more components of the roof and extends over a nailer, such as, for example, a wood nailer, positioned on top of the sidewall, thereby covering the uppermost portion of the sidewall and providing a waterproof layer over the surface of the roof of building. One non-limiting advantage of the roof edging system of the present invention is that the roof edging system can be designed to provide a waterproof and/or water-resistant seal around the edge of the roof of a building.

In another and/or alternative non-limiting aspect of the present invention, there is provided a roof edging system having a base anchor, a fascia cover, and a compression system. The base anchor is not limited in shape, size or material. In one non-limiting configuration, the material used to form the base anchor is a rigid material, such as, for example, metal material (e.g., steel, aluminum, copper, etc.); however, other or alternative materials can be used (e.g., plastic material, polymer material, composite material, wood, ceramic material, etc.). The base anchor can include one or more flanges. The one or more flanges of the base anchor (when used) can be formed in a one-piece construction; however, this is not required. In one non-limiting configuration, the base anchor has an engagement flange, a locking flange, and a sealing flange; however, this is not required. In such a configuration, the engagement flange can extend upwardly from the sealing flange and can comprise a generally hooked shape, the locking flange can extend downwardly in a direction opposite the engagement flange, and the sealing flange can extend outwardly from (e.g., perpendicularly or at some other angle) from the region of engagement with the engagement flange. In one non-limiting arrangement, the sealing flange is generally parallel to the top surface of the roof of the building; however, this is not required. The sealing flange is typically positionable between the engagement flange and the locking flange; however, this is not required. In another and/or alternative non-limiting configuration, the base anchor is formed from multiple components. For example, the base anchor can be formed from a first component and a second component, wherein the first component includes the engagement flange and at least a portion of the locking flange, and wherein the second component includes the sealing flange and at least a portion of the locking flange; however, this is not required. In such a configuration, the two components of the base anchor can be connected (e.g., adhesive, welding, tack welding, rivet, screw, bolt, etc.) together to provide a complete base anchor; however, this is not required.

The base anchor is not limited in size. As such, the base anchor can be fitted to any pre-existing and/or future building as desired. In one non-limiting configuration, the height of the base anchor can be from about 2 inches to about 24 inches, more typically from about 3 inches to about 18 inches, and more typically from about 5 inches to about 12 inches. In another and/or alternative non-limiting configuration, the width of the base anchor can be from about 0.25 inches to many feet, typically about 0.4 inches to 24 inches, more typically 0.5 inches to 10 inches, still more typically from about 0.5 inches to about 8 inches, and even more typically from about 1 inch to about 6 inches.

In another and/or alternative non-limiting aspect of the present invention, the engagement flange of the base anchor is generally designed to engage a top portion of a fascia cover. The engagement flange can be integrally formed with the base anchor; however, this is not required. The engagement flange can be formed in a hook shape; however, this is not required. In one non-limiting configuration, the engagement flange includes a first angled portion extending upwardly and outwardly from the base anchor, a vertical portion extending upwardly from an end of the first angled portion, a horizontal portion extending approximately perpendicularly (e.g., about 80-100° and all values and ranges therebetween) from an end of the vertical portion opposite where the vertical portion and the first angled portion meet, and a second angled portion extending in a downward direction from an end of the horizontal portion opposite where the horizontal portion and the vertical portion meet; however, this is not required. The second angled portion can define an engagement end wherein the engagement end extends downwardly from a bottom end of the engagement flange; however, this is not required. The engagement end can include one or more connection arrangements for engagement with a fascia cover; however, this is not required. In another and/or alternative non-limiting aspect of the present invention, the horizontal portion of the engagement flange can include a groove wherein the groove extends longitudinally along at least a portion of the length of the horizontal portion; however, this is not required. The top surface of the horizontal portion can provide a mounting surface for the purpose of accommodating the attachment of one or more compression systems to the horizontal portion; however, this is not required. As can be appreciated, the engagement flange can include other or alternative shapes and/or configurations. The engagement portion is not limited in size, shape or material.

In another and/or alternative non-limiting aspect of the present invention, the locking flange of the base anchor is generally designed to be positionable about parallel to the sidewall of the building; however, this is not required. The locking flange can be integrally formed with the base anchor; however, this is not required. Similarly, the engagement flange, base anchor, locking flange, or any combination thereof can be formed in a one-piece construction; however, this is not required. In one non-limiting configuration, the locking flange is provided and/or positioned opposite the engagement flange; however, this is not required. The locking flange can be designed to include one or more holes and/or apertures for the purpose of receiving one or more fasteners (e.g., screws, nails, bolts, clips, pins, etc.); however, this is not required. The one or more holes and/or apertures (when used) are not limited in size and/or shape. In one non-limiting configuration, the diameter of the one or more holes and/or apertures (when used) can be from about 1/16 inches to about 2 inches, more typically from about 1/8 inches to about 1.75 inches, and more typically from about 1/4 inches to about 1 inch. The one or more holes and/or apertures can be designed to facilitate one or more fasteners as said one or more fasteners are secured into a nailer and/or sidewall of a building. In another and/or alternative non-limiting configuration, the locking flange can include one or more perforated portions wherein the perforated portions are designed to be easily and conveniently removed from the locking flange so as to facilitate in using the one or more fasteners with the locking flange; however, this is not required. Typically, the one or more holes and/or apertures are provided on a portion of the locking flange behind which a nailer is provided; however, this is not required. As such, the locking flange can facilitate the attachment of the roof edging system to a building. In another and/or alternative non-limiting configuration, the one or more holes and/or apertures can be provided on a first portion of the locking flange which has a greater thickness than a second portion of the locking flange; however, this is not required. The thickened portion of the locking flange can be provided for the purpose of improving the strength and rigidity properties of the locking flange, thereby improving the overall strength and rigidity of the roof edging system.

The locking flange can include one or more surface projections extending approximately perpendicularly from the locking flange; however, this is not required. The one or more surface projections can be designed to contact and/or engage a portion of the fascia cover; however, this is not required. As such, the one or more surface projections can be provided for the purpose of 1) spacing the overlaying fascia cover from the locking flange, and/or 2) providing structural support from for the overlaying fascia cover; however, this is not required.

The locking flange can optionally include one or more positioning connectors thereto. The positioning connector, when used, can be configured to maintain the locking flange on a wall and/or roof until the locking flange is more securely connected to the wall and/or roof. In one non-limiting configuration, the positioning connector extends approximately perpendicularly from the locking flange; however, this is not required. The positioning connector can optionally include a base and an extension. In one non-limiting arrangement, the positioning connector can be designed to temporarily and/or releasably connect the locking flange to a building until the base anchor is more securely fastened thereto with one or more fasteners; however, this is not required. In one non-limiting arrangement, the positioning connector can be attached to the side of a building at or near the roof such that the extension of the positioning connector is inserted into the building, and the base of the guide is positioned at or near the sidewall of the building. As such, when the positioning connector is attached to the building, the base of the positioning connector optionally provides a temporary attachment of the base anchor to the building. As can be appreciated, the positioning connector may be sufficient to hold the weight of the fascia system; however, this is not required. When the base anchor is attached to the sidewall of the building and fastened thereto with one or more fasteners, the positioning connector can be removed; however, this is not required. As can be appreciated, the positioning connector can remain connected between the base anchor and the building, thereby providing additional support therebetween. As such, the positioning connector can be provided for the purpose of 1) temporarily connecting the locking flange of the base anchor to a building, and/or 2) providing structural support between the building and the base anchor; however, this is not required.

In one non-limiting configuration, the locking flange includes an engagement end wherein the engagement end extends from a bottom end of the locking flange. The engagement end of the locking flange can be designed to engage a portion of the fascia cover. The engagement end of the locking flange can be formed with a horizontal portion extending approximately perpendicularly outwardly from an end of the locking flange, and a vertical portion extending approximately perpendicularly, downwardly from an end of the horizontal portion; however, this is not required. As can be appreciated, other or alternative non-limiting configurations of the engagement end can be used. In another and/or alternative non-limiting configuration, the locking flange includes an extension end wherein the extension end is designed to engage a portion of a base anchor extender (described in further detail later). The shape of the extension end is non-limiting. In one non-limiting configuration, the extension end is C-shaped so as to accept a generally T-shaped end of a base anchor extender; however, this is not required. As can be appreciated, other or alternative shapes and/or connection arrangements can be used.

In another and/or alternative non-limiting aspect of the present invention, the sealing flange of the base anchor is generally designed to be positionable about parallel to the roof of the building. The sealing flange can be integrally formed with the base anchor; however, this is not required. Similarly, the sealing flange, base anchor, engagement flange, locking flange, or any combination thereof can be formed in a one-piece construction. Typically, the sealing flange is designed to frictionally engage at least a portion of the roof of a building; however, this is not required. The sealing flange can be designed to extend at a first end to the base anchor and can include a flange member provided on a second end opposite where the base anchor and sealing flange meet; however, this is not required. In one non-limiting configuration, a portion of the sealing flange is designed to include a serrated section; however, this is not required. In one non-limiting configuration, the serrated section of the sealing flange is provided across about 20-100% (and all values and ranges therebetween) of the sealing flange, more typically from about 25% to about 75%, and more typically from about 30% to about 70% of the sealing flange. The serrated portion (when used) can include one or more teeth, cutouts, etc. The size and shape of the teeth in the serrated section is non-limiting. For example, the teeth can extend from about 0.01 inches to about 1 inch from the sealing flange; however, this is not required. The serrate portion (when used) can facilitate is securing the sealing flange in position to a portion of the roof; however, this is not required. The front end of the sealing flange can optionally include a downwardly angled portion; however, this is not required. The downwardly angled portion (when used) can facilitate in anchoring, sealing, etc. the sealing flange to the roof; however, this is not required.

In another and/or alternative non-limiting aspect of the present invention, the roof edging system includes a sealant material; however, this is not required. The roof edging system can include one or more types of sealant materials; however, this is not required. The type of sealant material is non-limiting. For example, the sealant material can include fluid sealant, gel sealant, solid sealant, etc. In one non-limiting example, the sealant material is an adhesive material; however, this is not required. In another and/or alternative non-limiting example, the sealant material is a polyether sealant; however, this is not required. At least a portion of the sealant material can be provided at or near the corner of the roof edging system where one or more components of the roof edging system engage with the roofing of the building. Typically, the roof edging system is placed over a roofing membrane. Thus, the sealant material can be provided for the purpose of 1) creating a waterproof and/or water-resistant engagement between the roof edging system and the roofing membrane, and/or 2) securing one or more components of the roof edging system to the roofing membrane; however, this is not required. In operation, the sealant material can be applied to the roof edging system and/or the corner of the roof of a building such that when the roof edging system is caused to move at least partially into engagement with the edge of a roof, the sealant material is caused to spread along both the vertical portion of the roofing membrane and the top surface of the roofing membrane; however, this is not required. As such, the sealant material can be used to provide an improved waterproof seal between said roof edging system and the roofing membrane. In one non-limiting configuration, the sealant material is provided at or near the corner of the roof edging system where the locking flange meets the sealing flange; however, this is not required. In such a configuration, as the roof edging system is caused to move into engagement with the roofing membrane, the sealant material is forced to spread along 1) the vertical portion of the roofing membrane, and/or 2) the top surface of the roofing membrane, thereby providing an improved waterproof seal between said roof edging system and the roofing membrane. In another and/or alternative non-limiting configuration, the sealant material can be provided between the serrated portion of the sealing flange and the top of the nailer; however, this is not required. As can be appreciated, the sealant material can be provided at any portion of the roof edging system such that a waterproof seal is provided.

In another and/or alternative non-limiting aspect of the present invention, the roof edging system can include at least one base anchor extender; however, this is not required. The base anchor extender (when used) is designed to attach to the extension end of the locking flange (as described above). The size, shape and material of the base anchor extender are non-limiting. In one non-limiting configuration, the base anchor extender has a generally planar, rectangular shape providing a first end and a second end. The first end can include a connection arrangement designed to engage with the extension end of the locking flange. Generally, the size and shape of the connection arrangement of the first end is designed to correspond to the size and shape of the extension end of the locking flange; however, this is not required. As such, in the non-limiting configuration described above where the extension end of the locking flange is a generally downwardly facing C-shaped member, the base anchor extender can comprise a general T-shaped first end designed to be releasably secured and/or suspended by the C-shaped extension end of the locking flange; however, this is not required. As can be appreciated, the base anchor extender can comprise other and/or alternative shapes or connection arrangements. The second end of the base anchor extender can include an engagement end similar in structure to the engagement end of the locking flange as described above; however, this is not required. As such, the engagement end of the base anchor extender can be formed from a horizontal portion extending approximately perpendicularly outwards from the end of the locking flange, and a vertical portion extending approximately perpendicularly downwards from an end of the horizontal portion; however, this is not required. In another and/or alternative non-limiting configuration, the second end of the base anchor extender includes an extension end such that multiple base anchor extenders can be connected together; however, this is not required. The base anchor extender can include one or more holes and/or apertures for the purpose of receiving one or more fasteners (e.g., screws, nails, bolts, clips, etc.). As such, the one or more holes and/or apertures can facilitate one or more fasteners as the one or more fasteners are secured to the sidewall of a building. As such, the base anchor extender can facilitate the attachment of the roof edging system to a building. In one non-limiting configuration, the one or more holes and/or apertures are provided on a portion of the base anchor extender behind which a nailer is provided; however, this is not required. In another and/or alternative non-limiting configuration, the one or more holes and/or apertures can be provided on a portion of the base anchor extender which has a greater thickness than a second portion of the base anchor extender; however, this is not required. The thickened portion of the base anchor extender can be provided for the purpose of improving the strength and rigidity of the base anchor extender. Similar to the locking flange as described above, the base anchor extender can include one or more surface projections for the purpose of 1)

spacing the overlaying fascia cover from the locking flange, and/or 2) providing structural support from for the overlaying fascia cover; however, this is not required.

In another and/or alternative non-limiting aspect of the present invention, the roof edging system includes a fascia cover. The fascia cover is designed to at least partially engage the base anchor, thereby providing an aesthetically pleasing appearance to the exterior of the roof edging system. The size, shape and material of the fascia cover are non-limiting. In one non-limiting configuration, the material used to form the fascia cover is a rigid material, such as, for example, metal material; however, other or alternative materials can be used (e.g., plastic material, composite material, sheet metal, aluminum, extruded aluminum, etc.). In one non-limiting configuration, the fascia cover can be designed to include a first vertical portion, a horizontal portion, and a second vertical portion. The first vertical portion can be formed in a generally planar, rectangular shape, and is designed to be positioned generally parallel to 1) the sidewall of the roof, and/or 2) the locking flange of the base anchor. In one non-limiting configuration, the first vertical portion is designed to be spaced apart from at least a portion of the locking flange; however, this is not required. In another and/or alternative non-limiting configuration, the bottom end of the first vertical portion can include an engagement end extending therefrom. In such a configuration, the engagement end of the first vertical portion is designed to at least partially engage the engagement end extending from the bottom end of the locking flange. The horizontal portion of the fascia cover can be connected approximately perpendicularly or at some other angle at a first end to an end of the first vertical portion opposite the engagement end; however, this is not required. In one non-limiting configuration, the horizontal portion is designed to at least partially extend over the top of the roof; however, this is not required. The second vertical portion can be connected approximately perpendicularly or at some other angle in a downward direction from an end of the horizontal portion opposite where the horizontal portion and the first vertical portion meet. In another and/or alternative non-limiting configuration, the bottom end of the second vertical portion can include an engagement end extending therefrom. In such a configuration, the engagement end of the second vertical portion is designed to at least partially engage the second angled portion extending from the bottom end of the engagement flange. The size and shape of the engagement ends of the fascia cover are non-limiting. In one non-limiting configuration, the size of the first vertical portion can be about equal to or greater than the size of the horizontal portion, thereby providing a generally U-shaped and/or hook-shaped fascia cover; however, this is not required. In one non-limiting configuration, the engagement end of the second vertical portion can include a hook member that extends along the length of the second vertical portion, said hook member designed to engage a portion of the engagement flange; however, this is not required. Similarly, the engagement end of the first vertical portion can include a hook member that extends along the length of the first vertical portion wherein the hook member is designed to engage a portion of the locking flange; however, this is not required. In another and/or alternative non-limiting aspect of the present invention, the fascia cover can include various designs and/or structures; however, this is not required. In one non-limiting configuration, the first vertical portion (i.e. the exterior facing surface of the fascia cover) provides a substantially planar surface; however, this is not required. As can be appreciated, the surface of the fascia cover can be linear or non-linear. In another and/or alternative non-limiting configuration, the fascia cover has one or more surface projections, such as, for example, bumps, ridges, grooves, plateaus, etc.; however, this is not required.

The fascia cover is not limited in size. In one non-limiting configuration, the height of the fascia cover can be from about 1.5 inches to about 30 inches, more typically from about 2 inches to about 20 inches, and more typically from about 3 inches to about 12 inches. In another and/or alternative non-limiting configuration, the width of the fascia cover can be from about 0.25 inches to several feet, more typically about 0.4 inches to about 10 inches, even more typically from about 0.5 inches to about 8 inches, and yet more typically from about 1 inch to about 6 inches. In another and/or alternative non-limiting configuration, the length of the one or more hook members can be from about 1/16 inches to about 2 inches, more typically from about 1/8 inches to about 1.75 inches, and more typically from about 1/4 inches to about 1 inch. In still another and/or alternative non-limiting configuration, the angle of the hook members can be from about 10° to about 90°, more typically from about 20° to about 70°, and more typically from about 35° to about 55°; however, this is not required.

In another and/or alternative non-limiting aspect of the present invention, there is provided a roof edging system having one or more splice plates; however, this is not required. The one or more splice plates (when used) can be used to releasably secure neighboring components of the roof edging system, such as, for example, between base anchors, and to provide a seamless transition between roof edging system components. As such, the one or more splice plates are designed to allow the roof edging system to be provided continuously across the length of a building without gaps between components; however, this is not required. In one non-limiting configuration, the one or more splice plates are provided between sections of base anchors at the end joints; however, this is not required. The one or more splice plates can alternatively be used to 1) provide structural support to the fascia cover, and/or 2) to partially and/or fully transfer tension between a compression system and the fascia cover; however, this is not required. The size, shape and material of the one or more splice plates are non-limiting. The one or more splice plates (when used) can include a first vertical portion, a horizontal portion, and a second vertical portion. The first vertical portion can be formed in a generally planar, rectangular shape, and is designed to be positioned parallel to 1) the sidewall of the roof, 2) the vertical portion of the fascia cover, and/or 3) the locking flange of the base anchor. In one non-limiting configuration, the first vertical portion is designed to be provided adjacent the locking flange; however, this is not required. The horizontal portion can be connected approximately perpendicularly at a first end to an end of the first vertical portion; however, this is not required. In one non-limiting configuration, the horizontal portion is designed to extend rearwardly over the top of the roof; however, this is not required. The second vertical portion can be connected approximately perpendicularly or at some other angle in a downward direction from an end of the horizontal portion opposite where the horizontal portion and the first vertical portion meet. The size of the first vertical portion is typically greater than the size of the horizontal portion; however, this is not required. The one or more splice plates are not limited in size. In one non-limiting configuration, the height of the one or more splice plates can be from about 1.5 inches to about 30 inches, more typically from about 2 inches to about 20 inches, and more typically from about 3 inches to about 12 inches. In another and/or alternative non-limiting configuration, the width of the one or more splice plates can be from about 0.25 inches to about 10 inches, more typically from about 0.5 inches to about 8 inches, and more typically from about 1 inch to about 6 inches. The splice plates can optionally be provided in lengths up to 10 foot long sections (e.g., 0.3-10 ft. and all values and ranges therebetween); however, this is not required. In one non-limiting configuration, the size of the one or more splice plates are equal to or less than the size of the fascia cover; however, this is not required. As such, the one or more splice plates are typically designed to be provided between the base anchor components and the fascia cover; however, this is not required.

In another and/or alternative non-limiting aspect of the present invention, the roof edging system includes a compression system. The compression system is not limited in size, shape or material. Non-limiting examples of materials used in the compression system include rubber materials, plastic materials, composite materials, polymer materials, wood materials, metal materials, or any combinations thereof. In one non-limiting configuration, the compression system includes a compression portion and a compression base. Typically, the compression portion and the compression base are formed in a one-piece construction; however, this is not required. In one non-limiting configuration, the compression base is designed to have one or more surface projections for the purpose of partially or fully engaging with the groove or other type of connector on the top surface of the horizontal portion of the engagement flange; however, this is not required. As can be appreciated, the compression system can be connected in other or additional ways to the engagement flange. In one non-limiting configuration, the compression system is positionable on the mounting surface of the engagement flange, thereby able to interact with the overlying fascia cover and/or splice plate; however, this is not required. In one non-limiting configuration, the compression system comprises a PVC material; however, this is not required. In another and/or alternative non-limiting configuration, the compression system comprises a rubber material; however, this is not required. The compression system is designed and provided for the purpose of providing ample compression to allow the fascia cover to engage the base anchor and to snap into place. In addition, the compression system can be designed to provide enough resistance such that the compression system transfers tension to the horizontal portion of the fascia cover; however, this is not required. One non-limiting advantage of a roof edging system having the presently described compression system is that the compression system provides a balance of beneficial characteristics including 1) providing an ample amount of tension to the fascia cover for the purpose of preventing the face of the fascia cover from vibrating, and/or 2) not over-tensioning the face of the fascia cover. As such, the compression system provides the fascia cover with a smooth, flat surface absent the concave shape as exists in conventional roof edging systems. The compression system can also be used to form a liquid seal between the fascia and the engagement flange; however, this is not required.

In another and/or alternative non-limiting aspect of the present invention, the roof edging system and/or components thereof can be alternatively designed to fit buildings of various shapes and dimensions. For example, a portion of the roof edging system can include a bent and/or angled portion designed to fit the corner of the roof of a building. In another and/or alternative non-limiting example, a portion of the roof edging system can include a non-linear portion for the purpose of engaging a portion of a roof of a building which is non-linear; however, this is not required.

In another and/or alternative non-limiting aspect of the present invention, the base anchor and/or the fascia cover can be formed from about 1 foot to about 40 foot sections, more typically from about 5-foot sections to about 25-foot sections, and more typically from about 10-foot to 20-foot sections; however, this is not required. In one non-limiting configuration, the base anchor is formed in 10 foot sections; however, this is not required. As such, multiple base anchors can be connected together (e.g., welding, riveting, etc.) on site during installation; however, this is not required.

In operation, one non-limiting method of easily and conveniently installing and/or using a roof edging system as described above can comprise one or more steps. Initially, the compression system can be attached to the mounting surface of the engagement flange. Then, the base anchor can be attached to the sidewall of a building by securing one or more fasteners through one or more holes and/or apertures in the locking flange. Optionally, a base anchor extender can then be connected to the locking flange of the base anchor and further connected to the sidewall of the building and/or nailer by one or more fasteners; however, this is not required. Optionally, one or more splice plates can be positioned over the base anchor and compression system; however, this is not required. Subsequently, the fascia cover can be positioned over the splice plate (when used), base anchor, and base anchor extender (when used) such that the engagement end of the first vertical portion of the fascia cover is positioned at or near the engagement end of the locking flange, and the engagement end of the second vertical portion of the fascia cover is positioned at or near the second angled portion of the engagement flange. The fascia cover can be cause to move downwardly, thereby compressing the compression portion of the compression system. As the compression portion is compressed, the engagement end of the first vertical portion of the fascia cover and the engagement end of the second vertical portion of the fascia cover can simultaneously snap onto and hook the engagement end of the locking flange and the engagement end of the second vertical portion, respectively. As the fascia cover is released, the compression portion of the compression system can expand and extend upwardly towards its biased position, thereby taking up any slack between the base anchor and the fascia cover.

In operation, another and/or alternative non-limiting method of easily and conveniently installing and/or using a roof edging system as described above can comprise one or more steps. Initially, the compression system can be attached to the top surface of the engagement flange. Then, the base anchor can be attached to the sidewall of a building by securing one or more fasteners through the holes and/or apertures of the locking flange to the sidewall of the building and/or nailer. Optionally, a base anchor extender can then be connected to the locking flange of the base anchor and further connected to the sidewall of the building and/or nailer by one or more fasteners; however, this is not required. Optionally, one or more splice plates can be positioned over the base anchor and compression system; however, this is not required. Subsequently, the engagement end of the first vertical portion of the fascia cover can be positioned around the engagement end of the locking flange, thereby "hooking" the locking flange. The fascia cover can then be rotated and/or pivoted in a forward direction over the roof of the building such that the engagement end of the second vertical portion of the fascia cover is positioned at or near the second angled portion of the engagement flange.

The fascia cover can then be caused to move downwardly, thereby compressing the compression portion of the compression system against the mounting surface of the engagement flange, and engaging the engagement end of the second vertical portion of the fascia cover to the second angled portion of the engagement flange. As the fascia cover is released, the compression portion of the compression system can expand and extend upwardly towards its biased position, thereby taking up any slack between the base anchor and the fascia cover.

It is accordingly one non-limiting object of the present invention to provide an improved roof edging system.

Another and/or alternative non-limiting object of the present invention is the provision of a roof edging system that includes a compression system.

Still another and/or alternative non-limiting object of the present invention is the provision of a roof edging system that includes a compression system that is used to provide resistance such that tension is transferred to a fascia cover.

Another and/or alternative non-limiting object of the present invention is the provision of a roof edging system including a base anchor, a fascia cover, and one or more compression systems.

These and other objects and advantages will become apparent from the discussion of the distinction between the invention and the prior art and when considering the preferred embodiment shown in the accompanying drawings.

BRIEF DESCRIPTION OF THE DRAWINGS

Reference may now be made to the drawings, which illustrate various embodiments that the invention may take in physical form and in certain parts and arrangement of parts wherein.

DETAILED DESCRIPTION OF A NON-LIMITING EMBODIMENT

Figure 1:
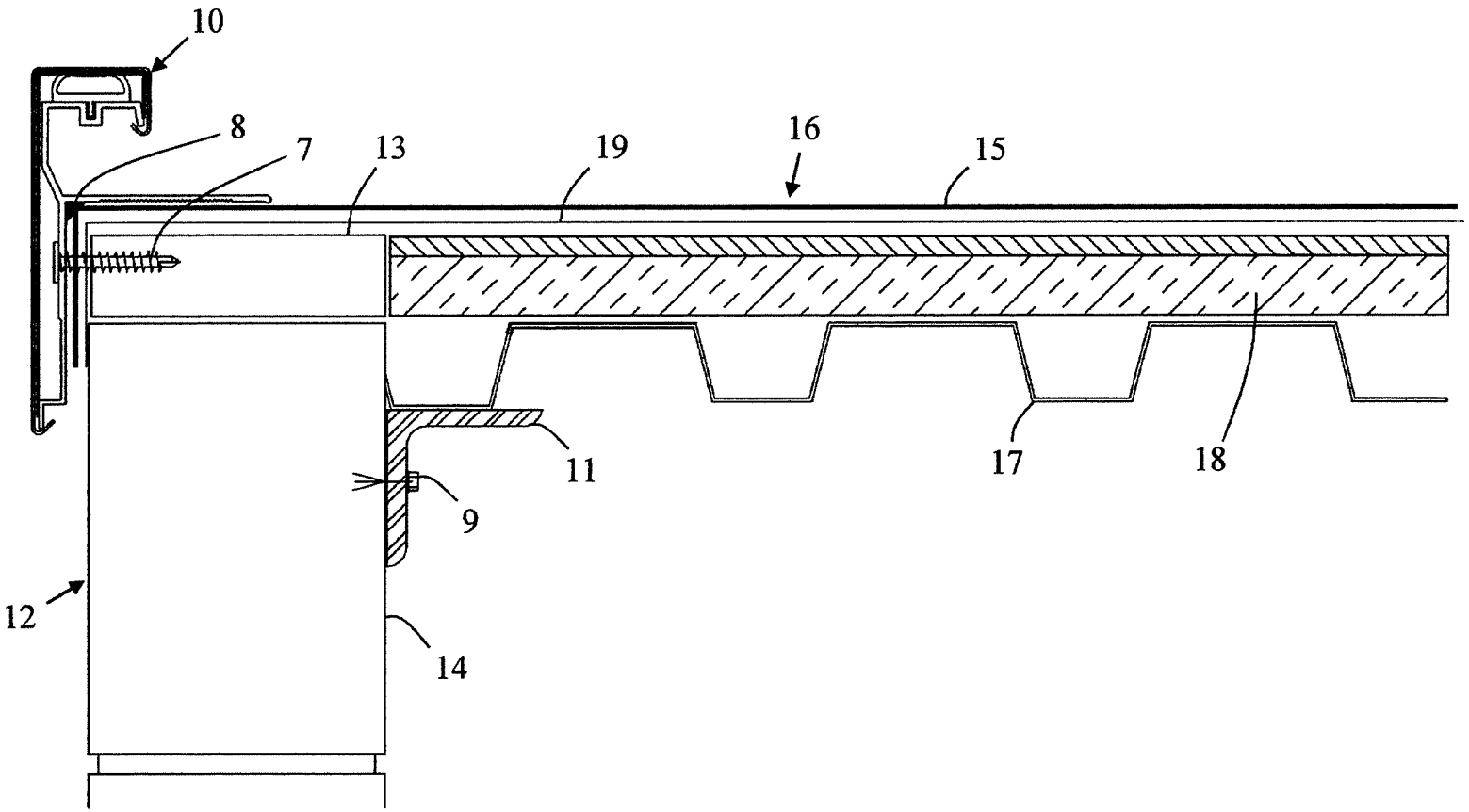
FIG. 1 is a side cross section view of a roof edging system in accordance with one non-limiting aspect of the present invention.

Referring now to the drawings, wherein the showings are for the purpose of illustrating at least one non-limiting embodiment of the invention only and not for the purpose of limiting the invention, FIGS. 1-11 illustrate various non-limiting roof edging systems in accordance with the present invention.

Referring now to FIG. 1, there is illustrated a roof edging system 10 connected to a building 12 having a sidewall 14 and a roof 16. One non-limiting roof 16 of building 12 includes multiple layers, such as, for example, a metal deck 17, insulation 18, base ply 19, and/or a roofing membrane 15. A bracket 11 can be used to support the one or more components of the roof 16 at or near the sidewall 14. A fastener 9 (e.g., bolt, screw, nail, clip, etc.) can be used to secure the bracket 11 to the sidewall 14. However, other or alternative connection means can be used (e.g., adhesives, etc.). Generally, roofing membrane 15 covers one or more components of the roof 16 and extends over a nailer 13, such as, for example, a wood nailer, positioned on top of the sidewall 14. As such, the roofing membrane 15 extends over the nailer 13 and extends approximately perpendicularly in a downward direction so as to cover the uppermost portion of the sidewall 14 and to provide a waterproof layer over the surface of the roof 16 of building 12. As can be appreciated, the roof edging system can be used with different types of roofing systems.

As illustrated in FIG. 1, the roof edging system 10 is positioned at or near the peripheral edge of the roof 16 of a building 12, and secured to nailer 13 by fastener 7. As also illustrated in FIG. 1, the roof edging system 10 can be positioned partially over the roofing membrane 15 and on both the top and side surfaces of the nailer 13 such that as the roof edging system 10 is secured to the nailer 13 by fastener 7. The roofing membrane 15 is optionally also secured to the nailer 13 by fastener 7. A sealant material 8 is illustrated as being provided at or near the corner of the roof edging system 10 where one or more components of the roof edging system are engaged with the roofing membrane 15; however, the use of the sealant material is optional. As also can be appreciated, the sealer can be positioned in other or additional regions between the roof edging system and the roofing membrane. The sealant material (when used) can be used to facilitate in securing the roof edging system to the roofing membrane and forming a liquid seal between the roof edging system and the roofing membrane. The type of sealant material used is non-limiting.

Various non-limiting configurations of roof edging systems in accordance with the present invention are described and illustrated in FIGS. 2-11. As can be appreciated, the non-limiting roof edging system configurations of FIGS. 2-11 can be connected to a building including any one or more components as illustrated in FIG. 1; however, this is not required. For example, FIGS. 2-11 are cross-section illustrations of roof edging systems connected to the roof of a building.

Figure 2:
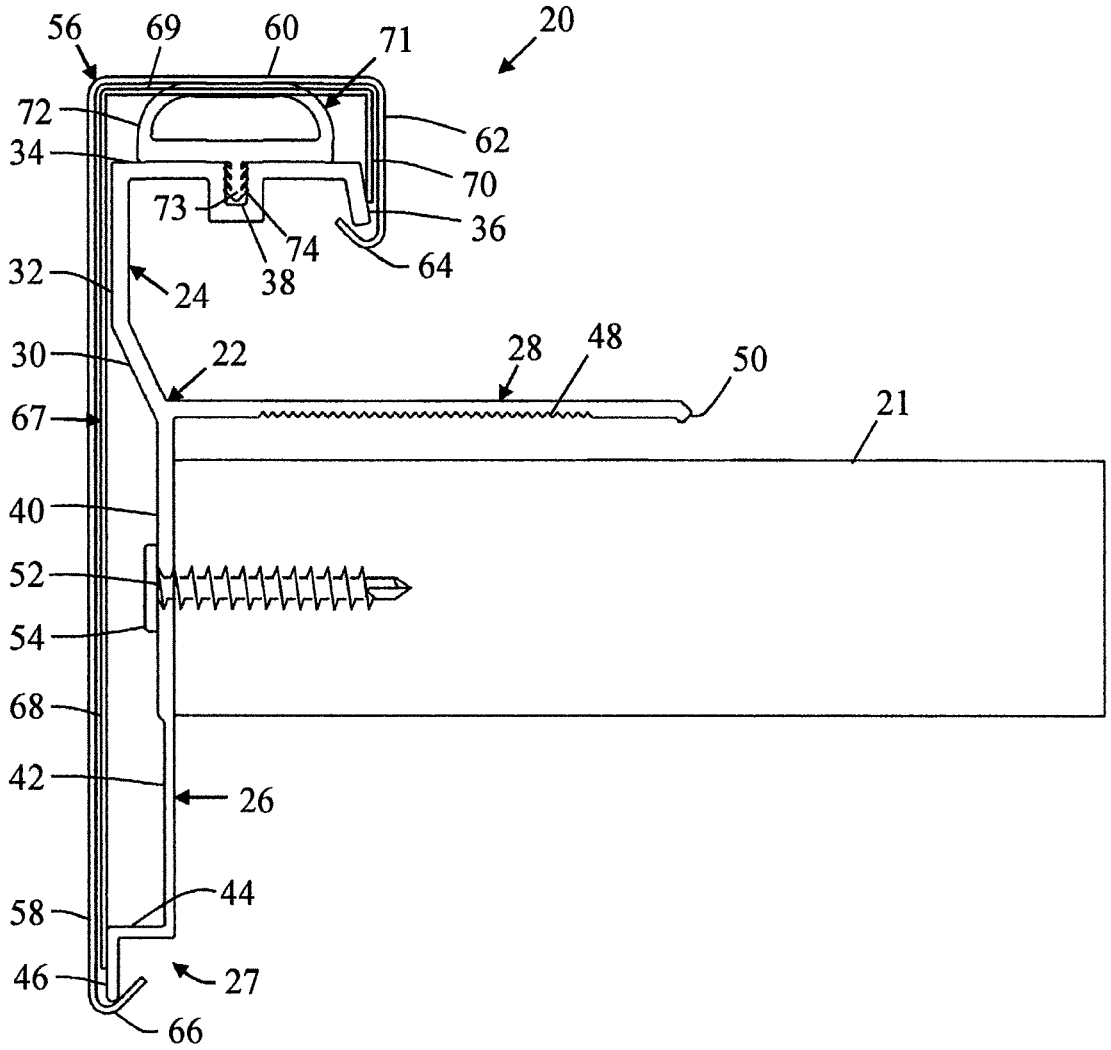
FIG. 2 is an enlarged view of the roof edge system of FIG. 1.

Referring now to FIG. 2, the roof edging system 20 of FIG. 1 is illustrated in more detail. Some of the roof structures illustrated in FIG. 1 are absent from FIG. 2 so that the features of the roof edge system can be better illustrated; however, it will be understood that the roof edge system of FIG. 2 and of FIGS. 3-11 can be used with the roof illustrated in FIG. 1 as previously described above.

The roof edging system 20 is illustrated as including a base anchor 22 having an engagement flange 24, a locking flange 26, and a sealing flange 28. As illustrated in FIG. 2, the engagement flange 24 extends upwardly from the sealing flange 26, the locking flange 26 extends downward from the sealing flange 28 in a direction opposite the engagement flange 24. The sealing flange 28 extends outwardly, approximately perpendicularly (e.g., about 80°-100° and all values and ranges therebetween) to the plane of the upper portion of the locking flange; however, other or alternative arrangements can be used. The engagement flange 24, locking flange 26, and sealing flange 28 are illustrated as being integrally formed in a one-piece construction; however, this is not required. One non-limiting advantage of a one-piece construction roof edging system is that the overall strength and rigidity of the system is improved.

Engagement flange 24 is illustrated as having an optional first angled portion 30, a vertical portion 32, a horizontal portion 34, and a second angled portion 36. The top surface of the horizontal portion 34 provides a mounting surface for the compression system 71; however, this is not required. Engagement flange 24 is also illustrated as including a groove 38 in horizontal portion 34. The groove 38 can optionally be designed to extend longitudinally along the length of the engagement flange 24. As can be appreciated, the groove can be substituted for a plurality of slots or other types of structures (ribs, etc.) used to facilitate in securing the compression system to the engagement flange. The shape of the groove is illustrated as being generally rectangular; however, other or alternative shapes can be used. Groove 38 is designed to engage with at least a portion of compression system 71. As can be appreciated, the compression system can be secured to the engagement flange by other or additional means (e.g., adhesive, melted connection, weld bead, solder, etc.). As can also be appreciated, the bottom of the compression system can include slot or recess that is configured to receive a structure extending upwardly from the surface of the engagement flange to facilitate in securing the compression system to the engagement flange. As can be appreciated, many other arrangements can be used to facilitate in securing the compression system to the engagement flange.

Figure 3:
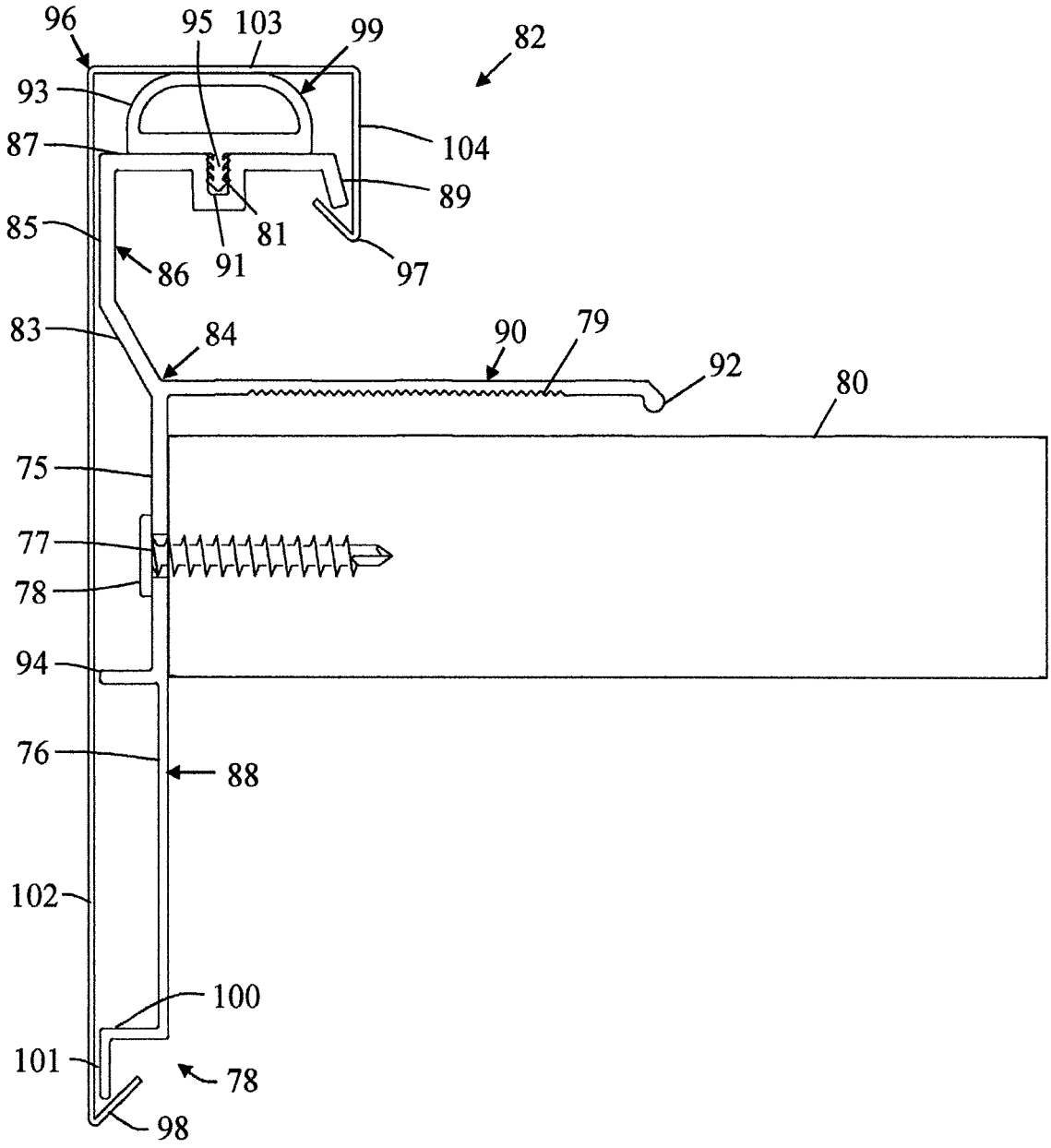
FIG. 3 is an enlarged view of a modification of the roof edge system of FIG. 1 in accordance with another and/or alternative non-limiting aspect of the present invention.

The compression system 71 is illustrated in FIG. 2 as including a compression portion 72 and a compression base 73. The compression portion and the compression base are optionally formed in a one-piece construction; however, this is not required. As can be appreciated, the compression portion and the compression base can be formed as separate components. Compression base 73 is illustrated as having one or more surface projections 74 designed to partially or fully engage with the internal surface of groove 38 of engagement flange 24. The size and shape of the compression base is non-limiting. As such, the compression portion 72 of the compression system 71 is illustrated as being positionable on the mounting surface of horizontal portion 34 and extending upwardly from the compression base 73. The compression portion can be formed of a compressible rubber, polymeric material (e.g., PVC); however, other materials can be used. The cross-sectional shape of the compression portion is illustrated as being generally D-shaped with the arcuate portion on the upper portion of the compression portion. As can be appreciated, other cross-sectional shapes can be used (e.g., square, rectangular, O-shaped, B-shaped, etc.). The interior of the compression system is illustrated as having a hollow cavity; however, this is not required. As can be appreciated, the compression system can include multiple cavities or no cavities. Generally, the compression system is formed of one material; however, it can be appreciated that the compression portion can be formed of a different material from the compression base. Generally, the base of the compression portion is flat and planar to lie on the top surface of horizontal portion 87. As illustrated in FIG. 3, the bottom of the compression portion is thicker than the top portion of the compression portion; however, this is not required.

Sealing flange 28 is illustrated as including an end flange 50 provided at or near the end of sealing flange 28 opposite the end that the sealing flange is connected to the engagement flange and/or the locking flange. Flange 50 is illustrated as having a generally square-shaped end, and is also illustrated as extending downwardly at an angle towards the top surface of nailer 21; however, this is not required. Sealing flange 28 is also illustrated as including a serrated portion 48 provided on one edge of sealing flange 28. The serrated portion 48 of sealing flange 28 can be provided for the purpose of 1) increasing the frictional engagement between the sealing flange 28 and the top surface of the nailer 21, and/or 2) preventing a sealant material (not shown) from leaking out from underneath sealing flange 28; however, this is not required. The serrated portion (when used) can be on the full or partial surface of the sealing flange. As illustrated in FIG. 2, the serrated portion is spaced from the two ends of the sealing flange; however, this is not required. Generally, the serrated portion is on 10-100% (and all values and ranges therebetween) of the bottom surface of the sealing flange, and typically 20-85% of the bottom surface.

Locking flange 26 is illustrated as having a hole and/or aperture 52 provided on a thick portion 40 of the locking flange. Hole and/or aperture 52 is designed to facilitate attachment of the roof edging system 20 to nailer 21. As such, hole and/or aperture 52 can be designed to facilitate allowing a fastener 54 to pass through the locking flange 26 and into the nailer 21, thereby securing at least a portion of the base anchor 22 to a building.

Locking flange 26 is also illustrated as including an engagement end 27 formed from a horizontal portion 44 extending approximately perpendicularly (e.g., about 80-100° and all values and ranges therebetween) and outwardly from an end of thin portion 42 of locking flange 26, and a vertical portion 46 extending approximately perpendicularly (e.g., about 80-100° and all values and ranges therebetween) and downwardly from an end of horizontal portion 44. The engagement end 27 of roof edging system 20 is designed to engage and releasably secure at least a portion of a fascia cover 56; however, this is not required.

Fascia cover 56 is illustrated in FIG. 2 as including a first vertical portion 58, a horizontal portion 60, and a second vertical portion 62. The horizontal portion 60 is illustrated as being connected approximately perpendicularly (e.g., about 80-100° and all values and ranges therebetween) at a first end to the first vertical portion 58, and at a second end connected approximately perpendicularly (e.g., about 80-100° and all values and ranges therebetween) to the second vertical portion 62. The descending end of the second vertical portion 62 is illustrated as including a hook member 64. Hook member 64 is illustrated as being generally curved in shape; however, this is not required. Similarly, the descending end of the first vertical portion 58 is illustrated as including a hook member 66. Hook member 66 is illustrated as being generally curved in shape; however, this is not required. In operation, hook member 64 is designed to at least partially engage the second angled portion 36 of engagement flange 24, and hook member 66 is designed to at least partially engage a portion of the engagement end 27 of locking flange 26 to thereby connect the fascia cover to the base anchor; however, this is not required.

When multiple roof edging systems 20 are secured to the roof of a building, one or more splice plates 67 can be used to 1) releasably secure neighboring components of the roof edging system 20, such as, for example, between base anchors 22, and/or 2) to provide a seamless transition between components; however, this is not required. In one non-limiting configuration, the one or more splice plates 67 are positionable between sections of base anchors 22 at the end joints; however, this is not required. The one or more splice plates 67 are illustrated as including a first vertical portion 68, a horizontal portion 69, and a second vertical portion 70. The horizontal portion 69 can be connected approximately perpendicularly at one end to one end of the first vertical portion 68 and approximately perpendicularly at one end to one end of the second vertical portion 70, thereby providing a generally hook-shaped splice plate; however, this is not required. In one non-limiting configuration, the size of the one or more splice plates 67 are about equal to or less than the size of the fascia cover 56; however, this is not required. As such, the one or more splice plates 67 are typically provided between the base anchor 22 components and the fascia cover 56; however, this is not required.

In operation, another and/or alternative non-limiting method of installing a roof edging system 20 as illustrated in FIG. 2 can include: 1) initially, the compression system 71 can be attached to the mounting surface of the engagement flange 24 by releasably securing the compression base 73 in groove 38; 2) next, the base anchor 22 can be attached to the sidewall of a building by securing a fastener 54 through hole and/or aperture 52 of locking flange 26 to the sidewall of the building and/or nailer 21; 3) then, splice plate 67 can optionally be positioned over base anchor 22; 4) subsequently, the fascia cover 56 can be attached by positioning hook member 66 around vertical portion 46 of engagement end 27 of locking flange 26 so as to "hook" vertical portion 46 and then rotating and/or pivoting fascia cover 56 over the roof such that hook member 64 is positioned at or near second angled portion 36 of engagement flange 24; and 5) the fascia cover 56 can then be caused to move downwardly, thereby compressing the compression portion 72 of compression system 71 and engaging hook member 64 of fascia cover 56 to the second angled portion 36 of engagement flange 24. As the fascia cover 56 is released, compression portion 72 of compression system 71 can expand and extend upwardly towards its biased position, thereby taking up any slack between the base anchor 22 and the fascia cover 56.

Referring now to FIG. 3, there is illustrated a roof edging system 82 in accordance with another and/or alternative non-limiting embodiment of the present invention. Roof edging system 82 is illustrated as including: a base anchor 84 having an engagement flange 86, a locking flange 88, and a sealing flange 90; a fascia cover 96; and, a compression system 99. Many of the components and features of the roof edging system of FIG. 3 are the same or similar to the components and features of the roof edging system of FIGS. 1-2, thus are incorporated herein and will not be repeated in detail herein.

Engagement flange 86 is illustrated as having a first angled portion 83, a vertical portion 85, a horizontal portion 87, and a second angled portion 89. The top surface of horizontal portion 87 can provide a mounting surface for the compression system. Engagement flange 86 is also illustrated as including a groove 91 in horizontal portion 87 extending longitudinally along the length of the engagement flange 86 and designed to engage with at least a portion of compression system 99. Compression system 99 is illustrated in FIG. 3 as including a compression portion 93 and a compression base 95. The compression base 95 has one or more surface projections 81 designed to at least partially engage with the internal surface of groove 91 on engagement flange 86. The compression portion 93 of compression system 99 is illustrated in FIG. 3 as being formed of a compressible rubber or polymeric material; however, other or alternative materials can be used.

Sealing flange 90 is illustrated as including a flange 92 provided at or near the end of sealing flange 90 opposite the base anchor 84. Flange 92 is illustrated as having a generally rounded and/or lobular-shaped end and is also illustrated as extending downwardly at an angle towards the top surface of nailer 80; however, this is not required. Sealing flange 90 is also illustrated as including a serrated portion 79 provided on one edge of sealing flange 90 for the purpose of 1) increasing the engagement between the sealing flange 90 and the nailer 80, and/or 2) preventing a sealant material (not shown) from leaking out from underneath sealing flange 90; however, this is not required.

Locking flange 88 is illustrated as having a hole and/or aperture 77 provided on a thick portion 75 of said locking flange. Hole and/or aperture 77 can be designed to facilitate the movement of a fastener 78 through the locking flange 88 and into nailer 80, thereby securing at least a portion of the base anchor 84 to a building.

Locking flange 88 is illustrated as also including a thin portion 76 and an engagement end 78 formed from a horizontal portion 100, and a vertical portion 101. The engagement end 78 of roof edging system 82 is designed to engage and releasably secure at least a portion of a fascia cover 96; however, this is not required. Locking flange 88 is also illustrated as including a surface projection 94 extending approximately perpendicularly from said locking flange. The surface protection is designed to contact or act a spacer or stop to the inner surface of the fascia cover when the fascia cover is connected to the base anchor. As can be appreciated, the surface protection 94 can be incorporated in in the base anchor of FIG. 1-2; however, this is not required.

Fascia cover 96 is illustrated in FIG. 3 as including a first vertical portion 102, a horizontal portion 103, and a second vertical portion 104. Similar to the non-limiting embodiment of FIG. 2, the descending end of the second vertical portion 104 is illustrated as including a hook member 97. Hook member 97 is illustrated as having a generally angular shape; however, this is not required. Similarly, the descending end of the first vertical portion 102 is illustrated as including a hook member 98. Hook member 98 is also illustrated as having a generally angular shape; however, this is not required.

Figure 4:
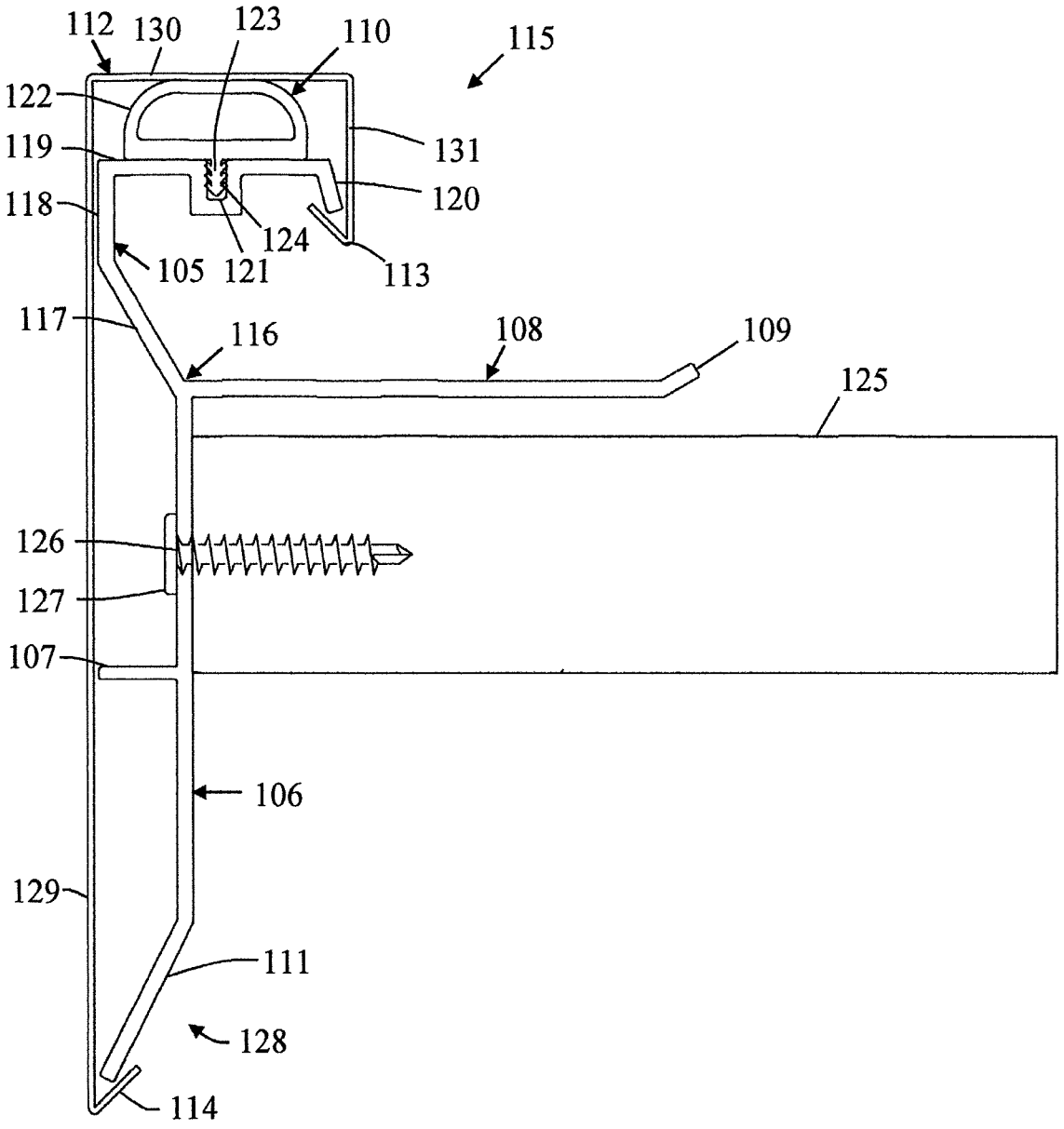
FIG. 4 is an enlarged view of a modification of the roof edge system of FIG. 1 in accordance with another and/or alternative non-limiting aspect of the present invention.

Referring now to FIG. 4, there is illustrated a roof edging system 115 in accordance with another and/or alternative non-limiting embodiment of the present invention. Roof edging system 115 is illustrated as including a base anchor 116 having an engagement flange 105, a locking flange 106, a sealing flange 108, a fascia cover 112, and a compression system 110. Many of the components and features of the roof edging system of FIG. 4 are the same or similar to the components and features of the roof edging system of FIGS. 1-3, thus are incorporated herein and will not be repeated in detail herein.

Engagement flange 105 is illustrated as having a first angled portion 117, a vertical portion 118, a horizontal portion 119, and a second angled portion 120. Engagement flange 105 is also illustrated as including a groove 121 in horizontal portion 119 extending longitudinally along the length of the engagement flange 105 and designed to engage with at least a portion of compression system 110. Compression system 110 is illustrated in FIG. 4 as including a compression portion 122 and a compression base 123. The compression base 123 has one or more surface projections 124 designed to engage with the internal surface of groove 121 on engagement flange 105. The compression portion 122 of compression system 110 is illustrated in FIG. 4 as being a rubber or polymeric material; however, other or alternative materials can be used.

Sealing flange 108 is illustrated as including a flange 109 provided at or near the end of sealing flange 108 opposite the base anchor 116. Flange 109 is illustrated as having a generally square and/or rectangular end and is also illustrated as extending upwardly at an angle away from the top surface of nailer 125; however, this is not required. The sealing flange is illustrated as being absent a serrated portion; however, it can be appreciated that the sealing flange can include a serrated portion.

Locking flange 106 is illustrated as having a uniform thickness and as having a hole and/or aperture 126 provided on the locking flange. Hole and/or aperture 126 can be designed to facilitate the movement of a fastener 127 through the locking flange 106 and into the nailer 125, thereby securing at least a portion of the base anchor 116 to a building. The thickness of the locking flange located about the locking flange is not increased as illustrated in FIGS. 1-3; however, it can be appreciated that the thickness of the locking flange in the region of the hole or aperture can be increased.

Locking flange 106 is illustrated as also including an engagement end 128 formed from an angled portion 111. The engagement end 128 of roof edging system 115 is designed to engage and/or releasably secure at least a portion of a fascia cover 112; however, this is not required. This configuration of the end of the locking flange is different from the ends of the locking portions illustrated in FIGS. 1-3. Locking flange 106 is also illustrated as including a surface projection 107 extending approximately perpendicularly from said locking flange.

Fascia cover 112 is illustrated in FIG. 4 as including a first vertical portion 129, a horizontal portion 130, and a second vertical portion 131. Similar to the non-limiting embodiments of FIGS. 1-3, the descending end of the second vertical portion 131 is illustrated as including a hook member 113. Hook member 113 is illustrated as having a generally angular shape; however, this is not required. Similarly, the descending end of the first vertical portion 129 is illustrated as including a hook member 114. Hook member 114 is illustrated as having a generally angular shape; however, this is not required.

Figure 5:
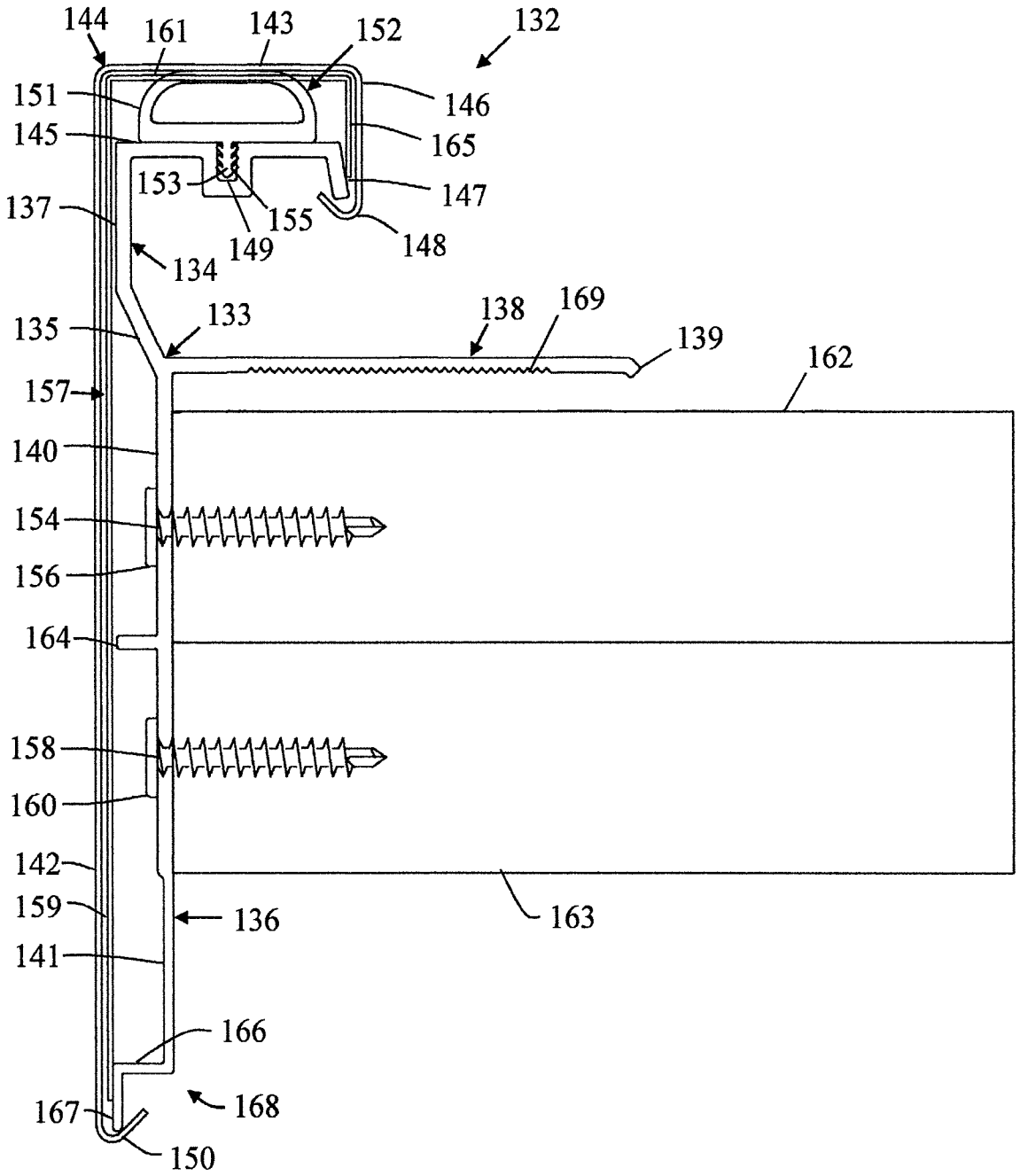
FIG. 5 is an enlarged view of a modification of the roof edge system of FIG. 1 in accordance with another and/or alternative non-limiting aspect of the present invention.

Referring now to FIG. 5, there is illustrated a roof edging system 132 in accordance with another and/or alternative non-limiting embodiment of the present invention. Roof edging system 132 is illustrated as including a base anchor 133 having an engagement flange 134, a locking flange 136, a sealing flange 138; a fascia cover 144, and a compression system 152. Many of the components and features of the roof edging system of FIG. 5 are the same or similar to the components and features of the roof edging system of FIGS. 1-4, thus are incorporated herein and will not be repeated in detail herein.

Engagement flange 134 is illustrated as having a first angled portion 135, a vertical portion 137, a horizontal portion 145, and a second angled portion 147. Engagement flange 134 is also illustrated as including a groove 149 in horizontal portion 145 extending longitudinally along the length of the engagement flange 134 and designed to engage with at least a portion of compression system 152. Compression system 152 is illustrated in FIG. 5 as including a compression portion 151 and a compression base 153. The compression base 153 has one or more surface projections 155 designed to engage with the internal surface of groove 149 on engagement flange 134. The compression portion 151 of compression system 152 is illustrated in FIG. 5 as being a rubber or polymeric material; however, other or alternative materials can be used.

Sealing flange 138 is illustrated as including a flange 139 provided at or near the end of sealing flange 138 opposite the base anchor 133. Flange 139 is illustrated as having a generally square end and is also illustrated as extending downwardly at an angle towards the top surface of first nailer 162; however, this is not required. Sealing flange 138 is also illustrated as including a serrated portion 169 provided on one edge of sealing flange 138; however, this is not required.

Locking flange 136 is illustrated as having a hole and/or aperture 154 provided on a thick portion 140 of said locking flange. Hole and/or aperture 154 can be designed to facilitate the movement of a fastener 156 through the locking flange 136 and into first nailer 162, thereby securing at least a portion of the base anchor 133 to a building. Locking flange 136 is also illustrated as having a hole and/or aperture 158 provided on a thick portion 140 of said locking flange spaced from hole and/or aperture 154. Hole and/or aperture 158 can be designed to facilitate the movement of a fastener 160 through the locking flange 136 and into second nailer 163, thereby securing at least a portion of the base anchor 133 to a building. As can be appreciated, the locking flange can include only a single hole or aperture as illustrated in FIGS. 1-4, or can include more than one hole or aperture. As can be appreciated, any of the locking flanges illustrated in FIGS. 1-10 can include one or more than one hole or aperture.

Locking flange 136 is illustrated as also including a thin portion 141 and an engagement end 168 formed from a horizontal portion 166, and a vertical portion 167. The engagement end 168 of roof edging system 132 is designed to engage and/or releasably secure at least a portion of a fascia cover 144; however, this is not required. Locking flange 136 is also illustrated as including a surface projection 164 extending approximately perpendicularly from the locking flange.

Fascia cover 144 is illustrated in FIG. 5 as including a first vertical portion 142, a horizontal portion 143, and a second vertical portion 146. Similar to the non-limiting embodiments of FIGS. 1-4, the descending end of the second vertical portion 146 is illustrated as including a hook member 148. Hook member 148 is illustrated as having a generally curved shape; however, this is not required. Similarly, the descending end of the first vertical portion 142 is illustrated as including a hook member 150. Hook member 150 is illustrated as having a generally angular shape; however, this is not required.

When multiple roof edging systems 132 are secured to the roof of a building, one or more splice plates 157 can be used to releasably secure neighboring components of the roof edging system 132, such as, for example, between base anchors 133. The one or more splice plates 157 are illustrated as including a first vertical portion 159, a horizontal portion 161, and a second vertical portion 165. The roof edging systems illustrated in FIGS. 1-10 can include the use of splice plates; however, this is not required.

Figure 6:
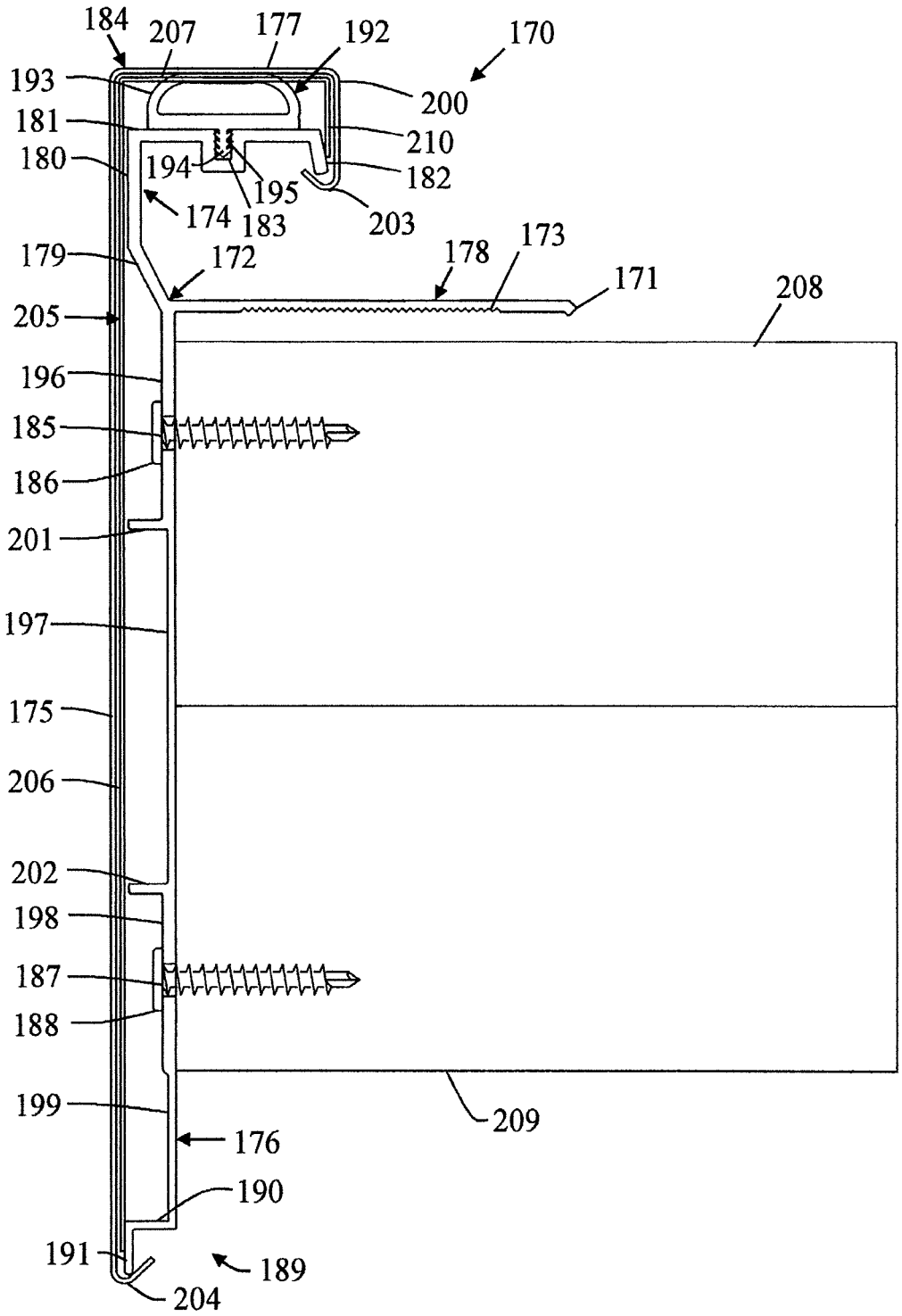
FIG. 6 is an enlarged view of a modification of the roof edge system of FIG. 1 in accordance with another and/or alternative non-limiting aspect of the present invention.

Referring now to FIG. 6, there is illustrated a roof edging system 170 in accordance with another and/or alternative non-limiting embodiment of the present invention. Roof edging system 170 is illustrated as including a base anchor 172 having an engagement flange 174, a locking flange 176, and a sealing flange 178, a fascia cover 184, and a compression system 192. Many of the components and features of the roof edging system of FIG. 6 are the same or similar to the components and features of the roof edging system of FIGS. 1-5, thus are incorporated herein and will not be repeated in detail herein.

Engagement flange 174 is illustrated as having a first angled portion 179, a vertical portion 180, a horizontal portion 181, and a second angled portion 182. Engagement flange 174 is also illustrated as including a groove 183 in horizontal portion 181 extending longitudinally along the length of the engagement flange 174 and designed to engage with at least a portion of compression system 192. Compression system 192 is illustrated in FIG. 6 as including a compression portion 193 and a compression base 194. The compression base 194 has one or more surface projections 195 designed to engage with the internal surface of groove 183 on engagement flange 174. Compression portion 193 of compression system 192 is illustrated in FIG. 6 as being a rubber or polymeric material; however, other or alternative types of material can be used.

Sealing flange 178 is illustrated as including a flange 171 provided at or near the end of sealing flange 178 opposite the base anchor 172. Flange 171 is illustrated as having a generally square end, and is also illustrated as extending downwardly at an angle towards the top surface of first nailer 208; however, this is not required. Sealing flange 178 is also illustrated as including a serrated portion 173 provided on one edge of sealing flange 178; however, this is not required.

Locking flange 176 is illustrated as having a hole and/or aperture 185 provided on a thick portion 196 of said locking flange. Hole and/or aperture 185 can be designed to facilitate the movement of a fastener 186 through the locking flange 176 and into first nailer 208, thereby securing at least a portion of the base anchor 172 to a building. Locking flange 176 is also illustrated as having a hole and/or aperture 187 provided on a thick portion 198 of locking flange 176. Hole and/or aperture 187 can be designed to facilitate the movement of a fastener 188 through the locking flange 176 and into second nailer 209, thereby securing at least a portion of the base anchor 172 to a building.

Locking flange 176 is illustrated as also including a thin portion 197 provided between thick portion 196 and thick portion 198, and as including a thin portion 199. Locking flange 176 is also illustrated in FIG. 6 as including an engagement end 189 formed from a horizontal portion 190, and a vertical portion 191. The engagement end 189 of roof edging system 170 is designed to engage and releasably secure at least a portion of a fascia cover 184; however, this is not required. Locking flange 176 is also illustrated as including a first surface projection 201 and a second surface projection 202. The first and second surface projections 201, 202 extend approximately perpendicularly from said locking flange. As can be appreciated, the locking flanges illustrated in FIGS. 1-5 and 7-10 can also include more than one surface projections. As can be appreciated, the locking flanges of FIGS. 1-10 can be absent any surface projection.

Fascia cover 184 is illustrated in FIG. 6 as including a first vertical portion 175, a horizontal portion 177, and a second vertical portion 200. Similar to the non-limiting embodiments of FIGS. 1-5, the descending end of the second vertical portion 200 is illustrated as including a hook member 203. Hook member 203 is illustrated as having a generally curved shape; however, this is not required. Similarly, the descending end of the first vertical portion 175 is illustrated as including a hook member 204. Hook member 204 is illustrated as having a generally angular shape; however, this is not required.

When multiple roof edging systems 170 are secured to the roof of a building, one or more splice plates 205 can be used to releasably secure neighboring components of the roof edging system 170, such as, for example, between base anchors 172. The one or more splice plates 205 are illustrated as including a first vertical portion 206, a horizontal portion 207, and a second vertical portion 210.

Figure 7:
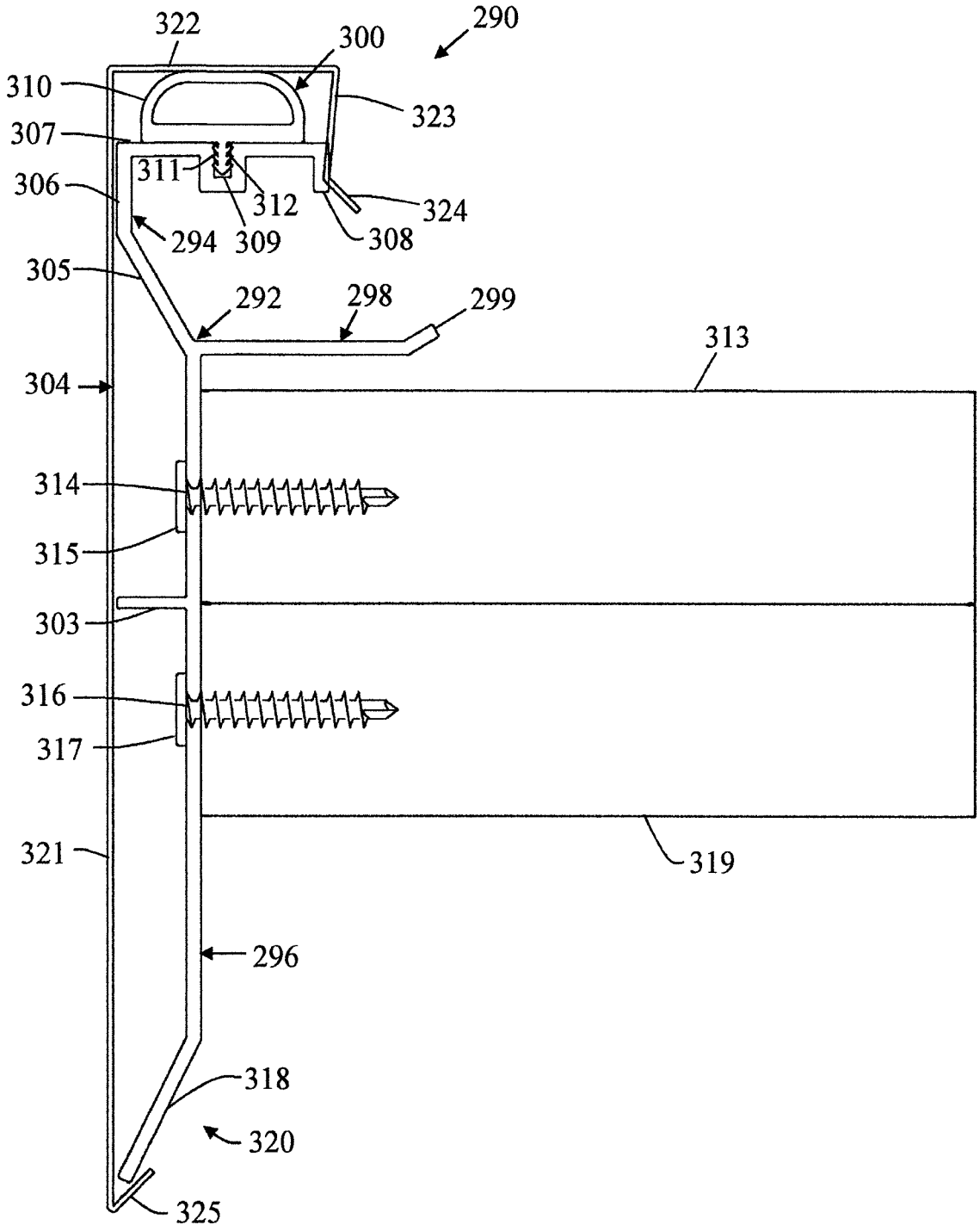
FIG. 7 is an enlarged view of a modification of the roof edge system of FIG. 1 in accordance with another and/or alternative non-limiting aspect of the present invention.

Referring now to FIG. 7, there is illustrated a roof edging system 290 in accordance with another and/or alternative non-limiting embodiment of the present invention. Roof edging system 290 is illustrated as including a base anchor 292 having an engagement flange 294, a locking flange 296, a sealing flange 298, a fascia cover 304, and a compression system 300. Many of the components and features of the roof edging system of FIG. 7 are the same or similar to the components and features of the roof edging system of FIGS. 1-6, thus are incorporated herein and will not be repeated in detail herein.

Engagement flange 294 is illustrated as having a first angled portion 305, a vertical portion 306, a horizontal portion 307, and a second angled portion 308. Engagement flange 294 is also illustrated as including a groove 309 in horizontal portion 307 extending longitudinally along the length of the engagement flange 294, and designed to engage with at least a portion of compression system 300. Compression system 300 is illustrated in FIG. 7 as including a compression portion 310 and a compression base 311. The compression base 311 has one or more surface projections 312 designed to engage with the internal surface of groove 309 on engagement flange 294. Compression portion 310 of compression system 300 is illustrated in FIG. 7 as being a rubber or polymeric material; however, other or alternative types of material can be used.

Sealing flange 298 is illustrated as including a flange 299 provided at or near the end of sealing flange 298 opposite the base anchor 292. Flange 299 is illustrated as having a generally square end, and is also illustrated as extending upwardly at an angle away from the top surface of first nailer 313; however, this is not required.

Locking flange 296 is illustrated as having a uniform thickness, and is illustrated as including a hole and/or aperture 314 designed to facilitate the movement of a fastener 315 through the locking flange 296 and into first nailer 313, thereby securing at least a portion of the base anchor 292 to a building. Locking flange 176 is also illustrated as having a hole and/or aperture 316 provided to facilitate the movement of a fastener 317 through the locking flange 296 and into second nailer 319, thereby securing at least a portion of the base anchor 292 to a building.

Locking flange 296 is also illustrated in FIG. 7 as including an engagement end 320 formed from an angled portion 318. The engagement end 320 of roof edging system 290 is designed to engage and releasably secure at least a portion of a fascia cover 304; however, this is not required. Locking flange 176 is also illustrated as including a surface projection 303 extending approximately perpendicularly from said locking flange, and positionable between hole and/or aperture 314 and hole and/or aperture 316; however, this is not required.

Fascia cover 304 is illustrated as having a vertical portion 321, a horizontal portion 322, an angled portion 323, and an engagement flange 324. Similar to the non-limiting embodiments of FIGS. 1-6, the descending end of the first vertical portion 321 is illustrated as including a hook member 325. Hook member 325 is illustrated as having a generally angular and/or pointed shape; however, this is not required. As illustrated in FIG. 7, engagement flange 324 of fascia cover 304 is designed to at least partially frictionally engage with second angled portion 308 of engagement flange 294, thereby at least partially securing the fascia cover 304 to the base anchor 292.

Figure 8:
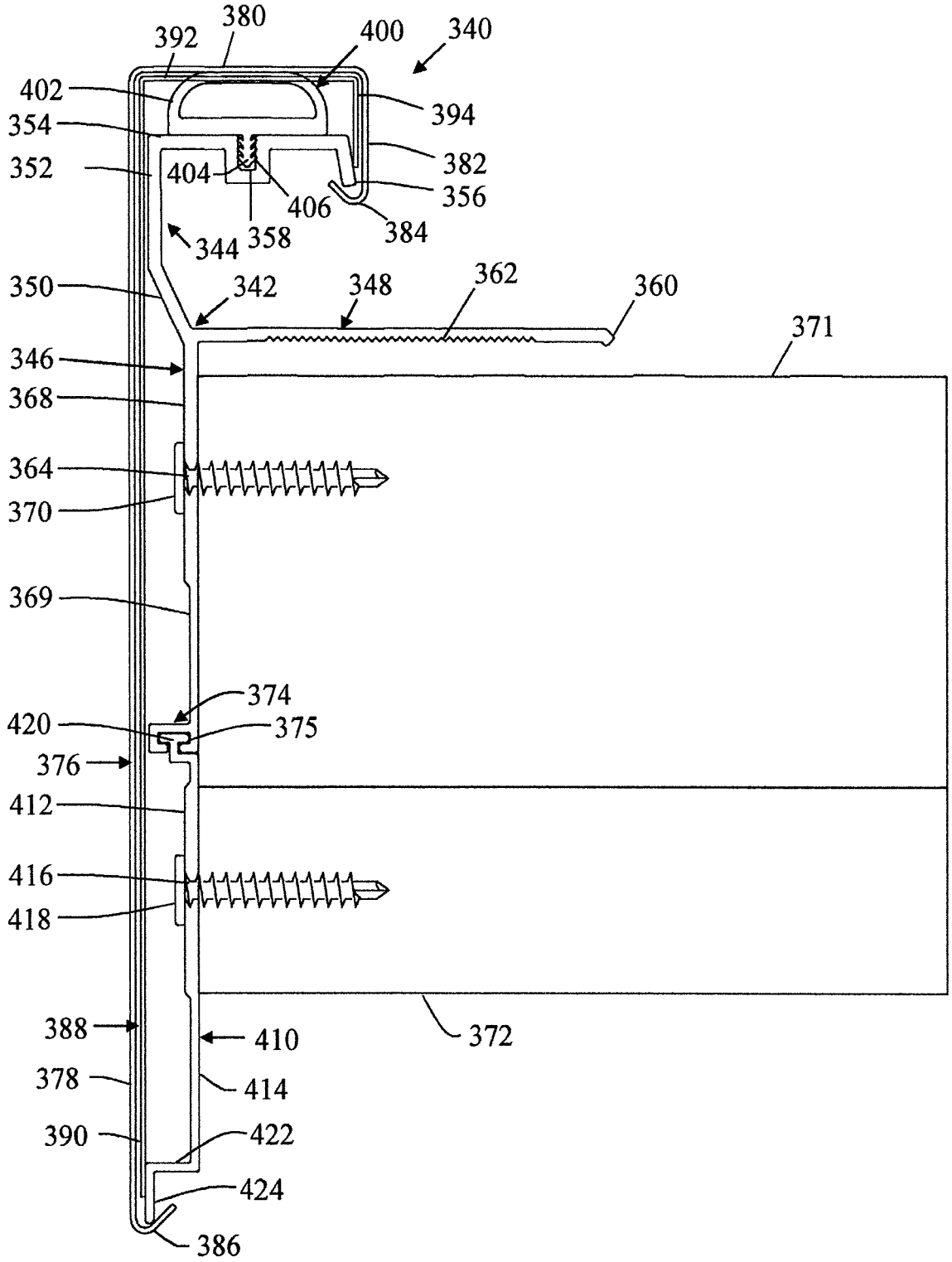
FIG. 8 is an enlarged view of a modification of the roof edge system of FIG. 1 in accordance with another and/or alternative non-limiting aspect of the present invention.

Referring now to FIG. 8, there is illustrated a roof edging system 340 in accordance with another and/or alternative non-limiting embodiment of the present invention. Many of the components and features of the roof edging system of FIG. 8 are the same or similar to the components and features of the roof edging system of FIGS. 1-7, thus are incorporated herein and will not be repeated in detail herein.

The roof edging system 340 is illustrated as including a base anchor 342 having an engagement flange 344, a locking flange 346, and a sealing flange 348. As illustrated in FIG. 8, the engagement flange 344 extends outwardly from the base anchor 342, the locking flange 346 extends downwardly from base anchor 342 in the direction opposite the engagement flange 344, and the sealing flange 348 extends outwardly, approximately perpendicularly (e.g., about 80-100°) from the base anchor 342; however, other or alternative arrangements can be used. The engagement flange 344, locking flange 346, and sealing flange 348 are illustrated as being integrally formed in a one-piece construction; however, this is not required.

Engagement flange 344 is illustrated in FIG. 8 as including a first angled portion 350, a vertical portion 352, a horizontal portion 354, and a second angled portion 356. Engagement flange 344 is also illustrated as including a groove 358 designed for engagement with at least a portion of a compression system 400.

Compression system 400 is illustrated as comprising a compression portion 402 and a compression base 404. The compression base 404 has one or more surface projections 406 designed to partially or fully engage with the groove 358 on the top surface of the horizontal portion 354 of the engagement flange 344.

Sealing flange 348 is illustrated as including a flange 360 provided at or near the end of sealing flange 348 opposite the base anchor 342. Flange 360 is illustrated as having a generally square-shaped end and is illustrated as extending downwardly; however, this is not required. Sealing flange 348 is also illustrated as including a serrated portion 362 provided on one edge of sealing flange 348.

Locking flange 346 is illustrated as having one or more holes and/or apertures 364 provided on a thick portion 368 of locking flange 346. Holes and/or apertures 364 are designed to facilitate the movement of a fastener 370 through the locking flange 346 of base anchor 342 into first nailer 371 for the purpose of securing the base anchor 342 to a building.

The locking flange 346 is illustrated as having a thin portion 369, and as including an engagement end 374 extending approximately perpendicularly and outwardly from the end of the locking flange 346, and defining a cavity 375 to receive a base anchor extender 410. The size and shape of the cavity 375 is non-limiting; however, it can be appreciated that the size and shape of the cavity 375 are typically designed to correspond to the engagement end of a base anchor extender 410.

Base anchor extender 410 is illustrated in FIG. 8 as having a thick portion 412 and a thin portion 414; however, it can be appreciated that the thickness of the base anchor extender can be uniform. The length of the base anchor extender is non-limiting. The thick portion 412 of base anchor extender 410 is illustrated as having a hole and/or aperture 416 designed to facilitate attachment of a fastener 418 through said hole and/or aperture 416 for the purpose of attaching the base anchor extender 410 to second nailer 372. A first end of the base anchor extender 410 is illustrated as having an engagement tab 420 designed to at least partially engage with engagement member 374 of locking flange 346. A second end of the base anchor extender 410 is illustrated as having an engagement end formed from a horizontal portion 422 extending approximately perpendicularly and outwardly from an end of the base anchor extender 410, and a vertical portion 424 extending perpendicularly from an end of the horizontal portion 422 and approximately parallel to the base anchor extender 410.

Roof edging system 340 is illustrated as also including a fascia cover 376. The fascia cover 376 is illustrated as including a first vertical portion 378, a horizontal portion 380, and a second vertical portion 382. The horizontal portion 380 is illustrated as being connected about perpendicularly at a first end to the first vertical portion 378, and at a second end connected about perpendicularly to the second vertical portion 382. The descending end of the second vertical portion 382 is illustrated as including a hook member 384. Hook member 384 is illustrated as being generally curved in shape; however, this is not required. Similarly, the descending end of the first vertical portion 378 is illustrated as including a hook member 386. Hook member 386 is illustrated as being generally curved in shape; however, this is not required.

One or more splice plates 388 can be used to releasably secure neighboring components of the roof edging system 340, such as, for example, between base anchors 342, and to provide a seamless transition between components. The one or more splice plates 388 are illustrated as being positionable between sections of base anchors 342 at the end joints; however, this is not required. The one or more splice plates 388 are illustrated as including a first vertical portion 390, a horizontal portion 392, and a second vertical portion 394. The size of the first vertical portion 390 is illustrated as being greater than the size of the horizontal portion 392 and the second vertical portion 394; however, this is not required. The horizontal portion 392 can be connected perpendicularly at a first end to one end of the first vertical portion 390, and perpendicularly at a second end to one end of the second vertical portion 394, thereby providing a generally hook-shaped splice plate; however, this is not required. In one non-limiting configuration, the size of the one or more splice plates 388 are about equal to or less than the size of the fascia cover 376; however, this is not required. As such, the one or more splice plates 388 are typically provided between the base anchor 342 components and the fascia cover 376; however, this is not required.

In operation, a method of easily and conveniently installing a roof edging system 340 as illustrated in FIG. 8 can comprise one or more steps. The base anchor 346 can be attached to the sidewall of a building by securing one or more fasteners 370 through the holes and/or apertures 364 of the locking flange 346 to first nailer 371. Next, the base anchor extender 410 can be attached to the sidewall of the building by engaging the engagement tab 420 with the extension member 374 of the locking flange 346, and by securing one or more fasteners 418 through the holes and/or apertures 416 of the base anchor extender 410 to second nailer 372. Subsequently, the compression system 400 can be attached to the top surface of the engagement flange 344; subsequently, the fascia cover 376 can be attached by positioning the fascia cover 376 over the base anchor 342 and base anchor extender 410 such that the hook member 386 of the first vertical portion 378 is positioned at or near the locking end of the base anchor extender 410, and the hook member 384 of the second vertical portion 382 is positioned at or near the flange 356 of the engagement flange 344. The hook member 386 of the first vertical portion 378 of the fascia cover 376 can then be positioned around the locking end of the base anchor extender 410. The fascia cover 376 can then be rotated and/or pivoted such that the hook member 384 of the second vertical portion 382 of the fascia cover 376 can then be positioned at or near the flange 356 of the engagement flange 344. The fascia cover 376 can then be moved downwardly, thereby compressing the compression portion 402 of compression system 400 and engaging the hook member 384 of the second vertical portion 382 of the fascia cover 376 to the flange 356 of the engagement flange 344. As the fascia cover 376 is released, the compression system 400 can expand and extend upwardly towards its biased position, thereby taking up any slack between the base anchor 342 and the fascia cover 376.

Figure 9:
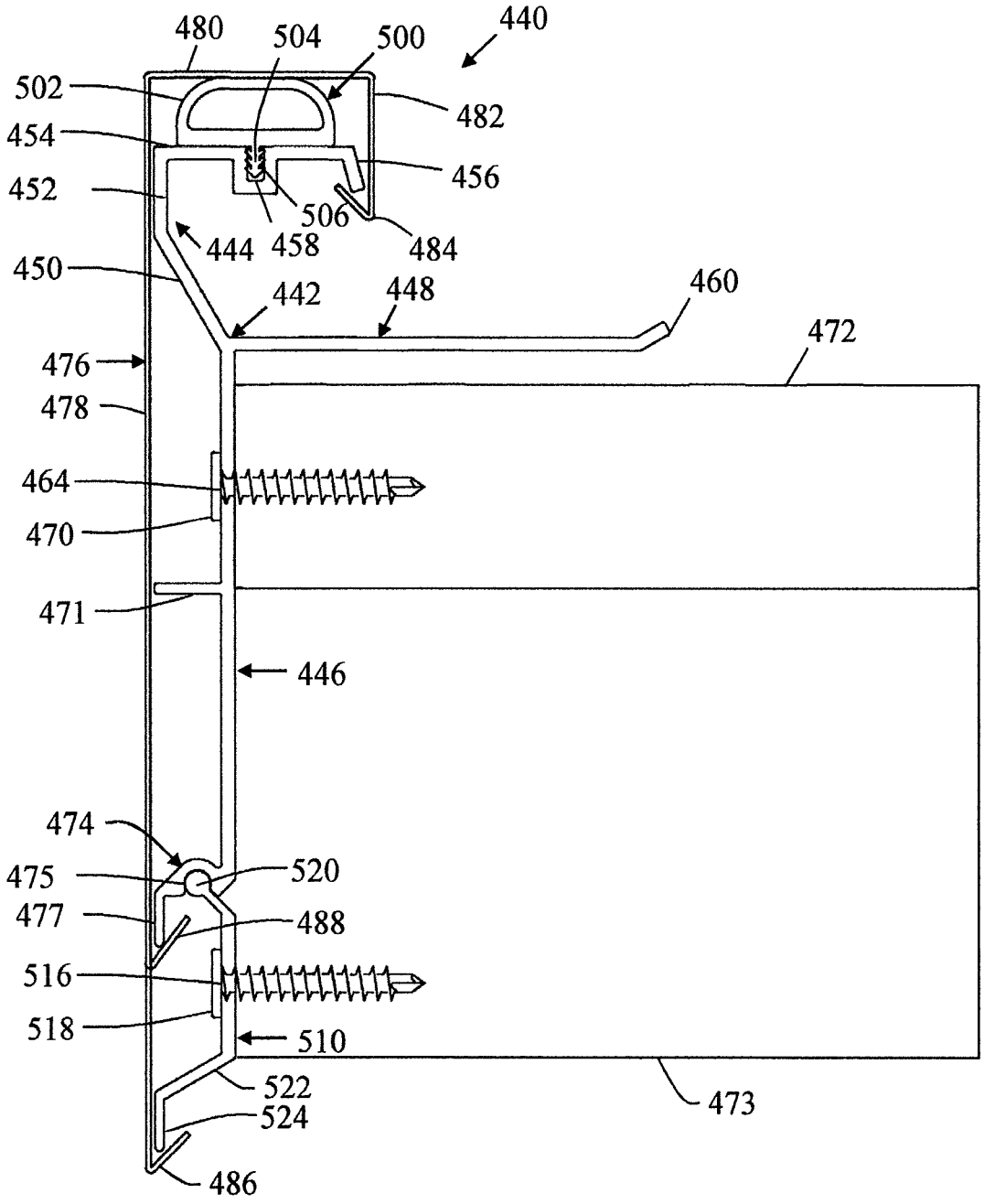
FIG. 9 is an enlarged view of a modification of the roof edge system of FIG. 1 in accordance with another and/or alternative non-limiting aspect of the present invention.

Referring now to FIG. 9, there is illustrated a roof edging system 440 in accordance with another and/or alternative non-limiting embodiment of the present invention. The roof edging system 440 is illustrated as including a base anchor 442 having an engagement flange 444, a locking flange 446, a sealing flange 448, a fascia cover 476, and a compression system 500. The engagement flange 444, locking flange 446, and sealing flange 448 are illustrated as being integrally formed in a one-piece construction; however, this is not required. Many of the components and features of the roof edging system of FIG. 9 are the same or similar to the components and features of the roof edging system of FIGS. 1-8, thus are incorporated herein and will not be repeated in detail herein.

Engagement flange 344 is illustrated in FIG. 9 as including a first angled portion 450, a vertical portion 452, a horizontal portion 454, and a second angled portion 456. Engagement flange 444 is also illustrated as including a groove 458. Groove 458 can extend longitudinally along the length of the engagement flange 444 and is designed to engage with a portion of a compression system 500.

Compression system 500 is illustrated as comprising a compression portion 502 and a compression base 504. The compression base 504 has one or more surface projections 506 designed to partially or fully engage with the groove 458 on the top surface of the horizontal portion 454 of the engagement flange 444. As such, the compression portion 502 of the compression system 500 is illustrated as extending upwardly from the compression base 504.

Sealing flange 448 is illustrated as including a flange 460 provided at or near the end of sealing flange 448 opposite the base anchor 442. Flange 460 is illustrated as having a generally square-shaped end and is illustrated as extending upwardly away from first nailer 472; however, this is not required.

Locking flange 446 is illustrated as having a generally uniform thickness and as including a surface projection 471. Locking flange 346 also includes one or more holes and/or apertures 464 provided to facilitate the movement of a fastener 470 through the locking flange 446 of base anchor 442 into first nailer 472 for the purpose of securing at least a portion of the base anchor 442 to a building; however, this is not required.

Locking flange 446 is also illustrated as including an engagement end 474 extending outwardly from the end of the locking flange 446 and defining a cavity 475 to receive an extension member. Cavity 475 is illustrated in FIG. 9 as having a generally circular shape; however, this is not required. In such a configuration, the circular shape of cavity 475 enables base anchor extender 510 to rotate and/or pivot relative to the cavity; however, this is not required. Engagement end 474 is also illustrated as having flange 477 designed to engage with at least a portion of fascia cover 476.

Base anchor extender 510 is illustrated as having a hole and/or aperture 516 designed to facilitate the movement of a fastener 518 through said hole and/or aperture 516 for the purpose of attaching the roof edging system 440 to second nailer 473. A first end of the base anchor extender 510 is illustrated as having an engagement tab 520 designed to at least partially engage with engagement end 474 of locking flange 446. A second end of the base anchor extender 510 is illustrated as having an engagement end formed from an angled portion 522 extending outwardly and downwardly from the end of the base anchor extender 510, and a vertical portion 524 extending downwardly from the end of the angled portion 522 and approximately parallel to the base anchor extender 510.

Fascia cover 476 is illustrated as including a first vertical portion 478, a horizontal portion 480, and a second vertical portion 482. The descending end of the second vertical portion 382 is illustrated as including a hook member 484. Hook member 484 is illustrated as being generally angled and/or pointed in shape; however, this is not required. Similarly, the descending end of the first vertical portion 478 is illustrated as including a hook member 486. Hook member 486 is illustrated as being generally angled and/or pointed in shape; however, this is not required. Fascia cover 476 is also illustrated as including a hook member 488 for the purpose of engaging flange 477 of engagement end 474; however, this is not required.

In operation, a method of easily and conveniently installing a roof edging system 440 as illustrated in FIG. 9 can comprise one or more steps. First, the base anchor 442 can be attached to the sidewall of a building by securing one or more fasteners 470 through the holes and/or apertures 464 of the locking flange 446 to nailer 472. Next, the base anchor extender 510 can be attached to the sidewall of the building by engaging the engagement tab 520 with the engagement end 474 of the locking flange 446, and by securing one or more fasteners 518 through the holes and/or apertures 516 of the base anchor extender 510 to nailer 473. Subsequently, the compression system 500 can be attached to the top surface of the engagement flange 444. Subsequently, the fascia cover 476 can be attached by positioning the fascia cover 476 over the base anchor 442 and base anchor extender 510 such that the hook member 486 of the first vertical portion 478 is positioned at or near the locking end of the base anchor extender 510, and the hook member 484 of the second vertical portion 482 is positioned at or near the flange 456 of the engagement flange 444. The hook member 486 of the first vertical portion 478 of the fascia cover 476 can be positioned around the locking end of the base anchor extender 510. The fascia cover 476 can then be rotated and/or pivoted such that the hook member 484 of the second vertical portion 482 of the fascia cover 476 can then be positioned at or near the flange 456 of the engagement flange 444. The fascia cover 476 can then be moved downwardly, thereby compressing the compression portion 502 of compression system 500 and engaging the hook member 484 of the second vertical portion 482 of the fascia cover 476 to the flange 456 of the engagement flange 444. As the fascia cover 476 is released, the compression system 500 can expand and extend upwardly towards its biased position, thereby taking up any slack between the base anchor 442 and the fascia cover 476.

Figure 10:
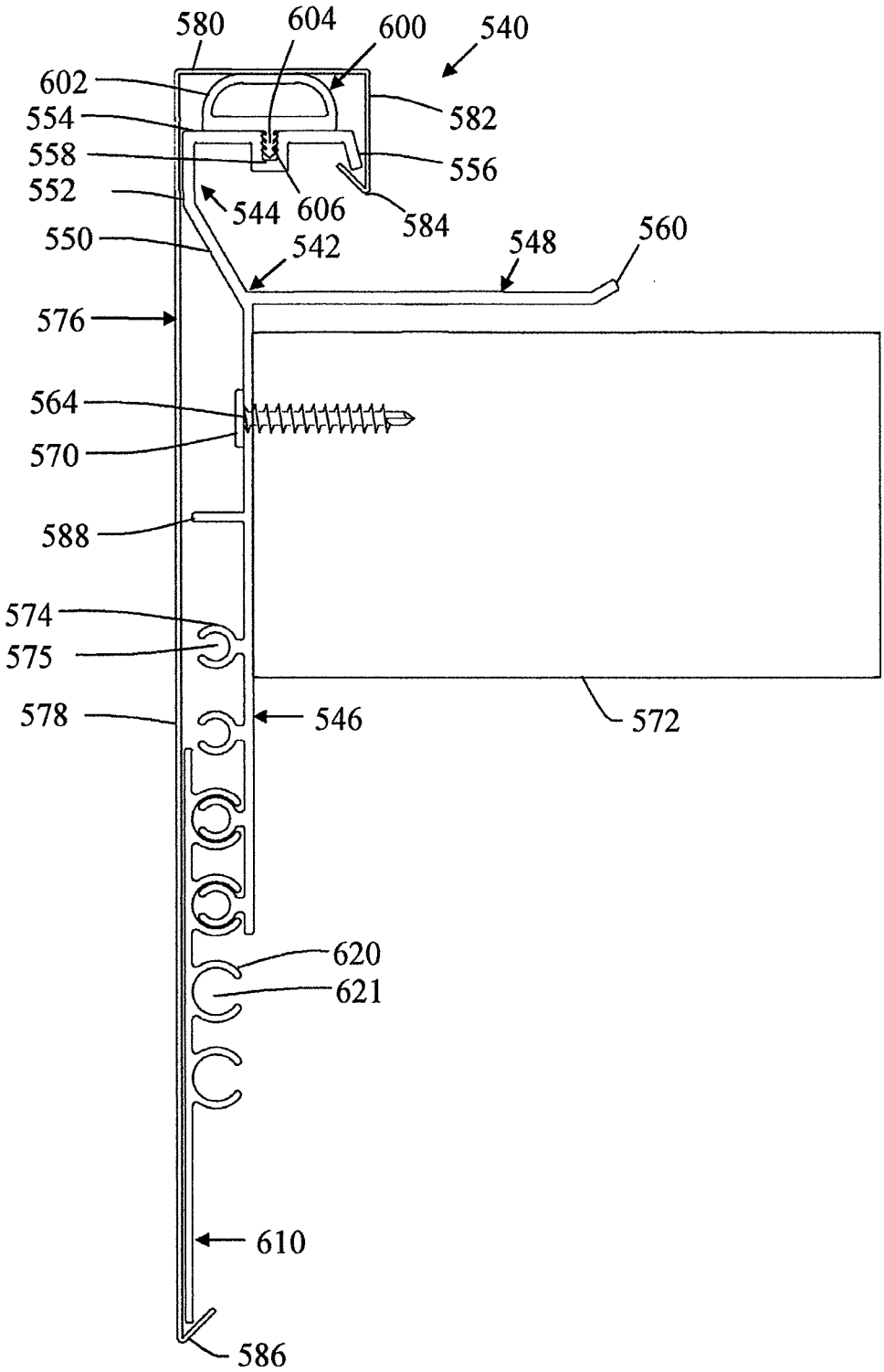
FIG. 10 is an enlarged view of a modification of the roof edge system of FIG. 1 in accordance with another and/or alternative non-limiting aspect of the present invention; and, FIG. 11 is an enlarged view of a modification of the roof edge system of FIG. 1 in accordance with another and/or alternative non-limiting aspect of the present invention.

Referring now to FIG. 10, there is illustrated a roof edging system 540 in accordance with another and/or alternative non-limiting embodiment of the present invention. Roof edging system 540 is illustrated as including a base anchor 542 having an engagement flange 544, a locking flange 546, a sealing flange 548, a base anchor extender 610, a fascia cover 576; and a compression system 600. Many of the components and features of the roof edging system of FIG. 10 are the same or similar to the components and features of the roof edging system of FIGS. 1-9, thus are incorporated herein and will not be repeated in detail herein.

Engagement flange 544 is illustrated in FIG. 10 as including a first angled portion 550, a vertical portion 552, a horizontal portion 554, and a second angled portion 556. Engagement flange 544 is also illustrated as including a groove 558. Groove 558 can extend longitudinally along the length of the engagement flange 544 and is designed to engage with compression system 600.

Compression system 600 is illustrated as comprising a compression portion 602 and a compression base 604. The compression base 604 has one or more surface projections 606 designed to partially or fully engage with the groove 558 on the mounting surface of the horizontal portion 554 of the engagement flange 544. As such, compression portion 602 of compression system 600 is illustrated as extending upwardly from compression base 604.

Sealing flange 548 includes a flange 560 provided at or near the end of sealing flange 548 opposite the base anchor 542. Flange 560 is illustrated as having a generally square-shaped end and is illustrated as extending upwardly away from nailer 572; however, this is not required.

Locking flange 546 is illustrated as having a generally uniform thickness and as including a hole and/or aperture 564 provided to facilitate the movement of a fastener 570 through the locking flange 546 of base anchor 542 into the nailer 572 for the purpose of securing the base anchor 542 to a building. Locking flange 546 is also illustrated as including a surface structure 588 extending outwardly therefrom; however, this is not required. Locking flange 546 is also illustrated as including a plurality of surface structures 574 extending approximately perpendicularly and outwardly from locking flange 546. Surface structures 574 are illustrated as having a cavity 575; however, this is not required. The shape of the cavity is illustrated as being generally C-shaped; however, it can be appreciated that the cavity can have other shapes (e.g., V-shaped, polygonal-shaped, oval shaped, etc.).

The roof edging system 540 is also illustrated in FIG. 10 as including a base anchor extender 610 having a uniform thickness. Base anchor extender 610 is illustrated as having a plurality of surface structures 620, each surface structure 620 defining a cavity 621. Cavity 621 can be designed to at least partially engage with surface structures 574 of locking flange 546. The shape of the cavity is illustrated as being generally C-shaped; however, it can be appreciated that the cavity can have other shapes (e.g., V-shaped, polygonal-shaped, oval shaped, etc.). The cavity is configured to receive surface structures 574; however, this is not required.

Roof edging system 540 is illustrated as also including a fascia cover 576. The fascia cover 576 is illustrated as including a first vertical portion 578, a horizontal portion 580, and a second vertical portion 582. The descending end of the second vertical portion 582 is illustrated as including a hook member 584. Hook member 584 is illustrated as being generally angled and/or pointed in shape; however, this is not required. Similarly, the descending end of the first vertical portion 578 is illustrated as including a hook member 586. Hook member 586 is illustrated as being generally angled and/or pointed in shape; however, this is not required.

In operation, a method of easily and conveniently installing and/or using roof edging system 540 as illustrated in FIG. 10 can comprise one or more steps. Initially, the compression system 600 can be attached to the top surface of the engagement flange 544. The base anchor 542 can then be attached to the sidewall of a building by securing one or more fasteners 570 through the holes and/or apertures 564 of the locking flange 546 to nailer 572. Next, the base anchor extender 610 can be attached to the locking flange 546 of base anchor 542 by engaging the surface structures 620 with the surface structures 574 of the locking flange 546. Subsequently, the fascia cover 576 can be attached by positioning the fascia cover 576 over the base anchor 542 and base anchor extender 610 such that the hook member 586 of the first vertical portion 578 is positioned at or near the end of the base anchor extender 610, and the hook member 584 of the second vertical portion 582 is positioned at or near the flange 556 of the engagement flange 544. The hook member 586 of the first vertical portion 578 of the fascia cover 576 can be positioned around the end of the base anchor extender 610. The fascia cover 576 can then be rotated and/or pivoted such that the hook member 584 of the second vertical portion 582 of the fascia cover 576 can then be positioned at or near the flange 556 of the engagement flange 544. The fascia cover 576 can then be moved downwardly, thereby compressing the compression portion 602 of compression system 600 and engaging the hook member 584 of the second vertical portion 582 of the fascia cover 576 to the flange 556 of the engagement flange 544. As the fascia cover 576 is released, the compression system 600 can expand and extend upwardly towards its biased position, thereby taking up any slack between the base anchor 542 and the fascia cover 576. The shape of the cavity is illustrated as being generally C-shaped; however, it can be appreciated that the cavity can have other shapes (e.g., V-shaped, polygonal-shaped, oval shaped, etc.).

Figure 11:
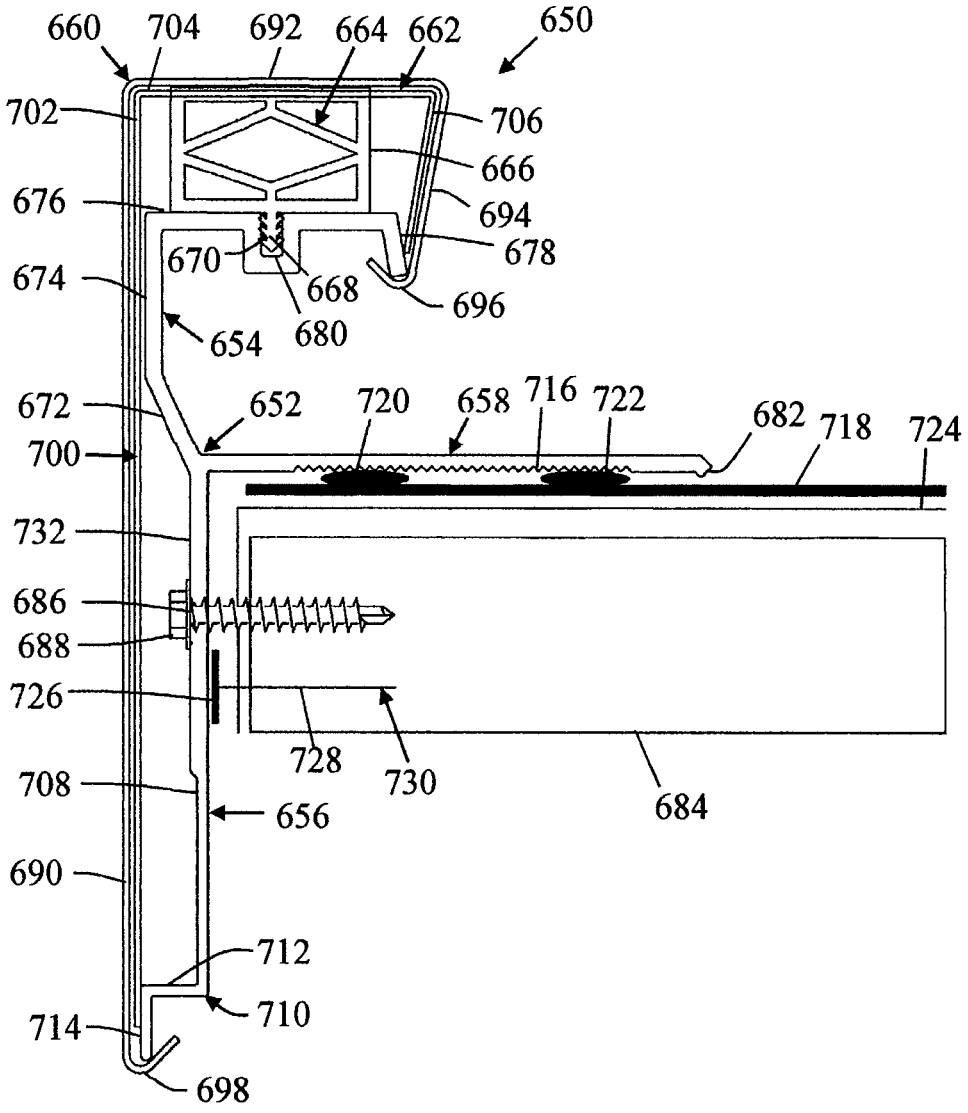

Referring now to FIG. 11, there is illustrated a roof edging system 650 in accordance with another and/or alternative non-limiting embodiment of the present invention. Roof edging system 650 is illustrated as including a base anchor 652 having an engagement flange 654, a locking flange 656, a sealing flange 658, a fascia cover 660, a splice plate 662, and a compression system 664. Many of the components and features of the roof edging system of FIG. 11 are the same or similar to the components and features of the roof edging system of FIGS. 1-10, thus are incorporated herein and will not be repeated in detail herein.

Engagement flange 654 is illustrated in FIG. 11 as including a first angled portion 672, a vertical portion 674, a horizontal portion 676, and a second angled portion 678. Engagement flange 654 is also illustrated as including a groove 680. Groove 680 can extend longitudinally along the length of the engagement flange 654 and is designed to engage with compression system 664.

Compression system 664 is illustrated as comprising a compression portion 666 and a compression base 668. The compression base 668 has one or more surface projections 670 designed to partially or fully engage with the groove 680 on the mounting surface of the horizontal portion 676 of the engagement flange 654. As such, compression portion 666 of compression system 664 is illustrated as extending upwardly from compression base 668.

The compression portion 666 can be formed of a compressible rubber, polymeric material (e.g., PVC); however, other materials can be used. The cross-sectional shape of the compression portion is illustrated as being generally rectangular-shaped. As can be appreciated, other cross-sectional shapes can be used (e.g., (O-shape, oval-shape, square-shape, D-shaped, B-shaped, etc.). The interior of the compression system 664 is illustrated as having multiple hollow cavities; however, this is not required. As can be appreciated, the compression system can optionally have fluid-filled cavities; however, this is not required. As can also be appreciated, the compression system can include a single or no cavities. Generally, the compression system 664 is formed of one material; however, it can be appreciated that the compression portion can be formed of a different material from the compression base.

Sealing flange 658 includes a flange 682 provided at or near the end of sealing flange 658 opposite the base anchor 652. Flange 682 is illustrated as having a generally square-shaped end and is illustrated as extending downwardly towards nailer 684; however, this is not required. Sealing flange 658 is also illustrated as including a serrated portion 716 provided on one edge of sealing flange 658. A first and second sealant material 720, 722 are illustrated as being provided at or near the serrated portion 716 of the sealing flange 658; however, the use of the sealant material is optional. As can also be appreciated, the sealer can be positioned in other or additional regions between the rood edging system and the roofing membrane. As such, the sealant material (when used) can be used to facilitate in securing the roof edging system to the roof of a building and forming a liquid seal between the roof edging system and the roof. The type of sealant material(s) is non-limiting. As can be appreciated, only one type or more than two types of sealer can be used; however, this is not required. The serrated portion 716 of sealing flange 658 can be provided for the purpose of 1) increasing the frictional engagement between the sealing flange 658 and the top surface of a roofing membrane 718, base ply 724, or the nailer 684, and/or 2) preventing one or more sealant materials 720, 722 from leaking out from underneath sealing flange 658; however, this is not required.

Locking flange 656 is illustrated as having a thick portion 732 having a hole and/or aperture 686 provided therethrough to facilitate the movement of a fastener 688 through the locking flange 656 of base anchor 652 into the nailer 684 for the purpose of securing the base anchor 652 to a building.

Locking flange 656 is also illustrated as including an engagement end 710 formed from a horizontal portion 712 extending approximately perpendicularly (e.g., about 80-100° and all values and ranges therebetween) and outwardly from an end of thin portion 708 of locking flange 656, and a vertical portion 714 extending approximately perpendicularly (e.g., about 80-100° and all values and ranges therebetween) and downwardly from an end of horizontal portion 712. The engagement end 710 of roof edging system 650 is designed to engage and releasably secure at least a portion of a fascia cover 660; however, this is not required.

The roof edging system 650 is also illustrated in FIG. 11 as including a positioning connector 730 having a base 726 and an extension 728. Positioning connector 730 can be used to temporarily secure the base anchor 652 to the nailer 684 during installation; however, this is not required. The type of connection between the base 726 of the positioning connector 730 and the base anchor 652 is non-limiting. For example, positioning connector 730 can be welded, adhesively connected, soldered, melt connected, etc. to the base anchor; however, this is not required. As can be appreciated, other or alternative connection arrangements can be used.

Roof edging system 650 is illustrated as also including a splice plate 700. The splice plate 700 is illustrated as including a first vertical portion 702, a horizontal portion 704, and a second vertical portion 706.

Roof edging system 650 is illustrated as also including a fascia cover 660. The fascia cover 660 is illustrated as including a first vertical portion 690, a horizontal portion 692, and a second vertical portion 694. The descending end of the second vertical portion 694 is illustrated as including a hook member 696. Hook member 696 is illustrated as being generally angled and/or pointed in shape; however, this is not required. Similarly, the descending end of the first vertical portion 690 is illustrated as including a hook member 698. Hook member 698 is illustrated as being generally angled and/or pointed in shape; however, this is not required.

In operation, a method of easily and conveniently installing and/or using roof edging system 650 as illustrated in FIG. 11 can comprise one or more steps. The compression system 664 is be attached to the top surface of the engagement flange 654. One or more positioning connector 730 can optionally be used to initially secure the base anchor to the sidewall of the building where the roof edging system is intended to be positioned; however, this is not required. The base anchor 652 can be securely attached to the sidewall of a building by securing one or more fasteners 688 through the holes and/or apertures 686 of the locking flange 656 to nailer 684. The splice plate 700 can optionally be positioned over base anchor 652. Subsequently, the fascia cover 660 can be attached by positioning the fascia cover 660 over the base anchor 652 such that the hook member 698 of the first vertical portion 690 is positioned at or near the end of the locking flange 656, and the hook member 696 of the second vertical portion 694 is positioned at or near the flange 678 of the engagement flange 654. The fascia cover 660 can then be rotated and/or pivoted such that the hook member 696 of the second vertical portion 694 of the fascia cover 660 can then be positioned at or near the flange 678 of the engagement flange 654. The fascia cover 660 can then be moved downwardly, thereby compressing the compression portion 666 of compression system 664 and engaging the hook member 696 of the second vertical portion 694 of the fascia cover 660 to the flange 678 of the engagement flange 654. As the fascia cover 660 is released, the compression system 664 can expand and extend upwardly towards its biased position, thereby taking up any slack between the base anchor 652 and the fascia cover 660.

While considerable emphasis has been placed herein on the structures and configurations of the preferred embodiments of the invention, it will be appreciated that other embodiments, as well as modifications of the embodiments disclosed herein, can be made without departing from the principles of the invention. These and other modifications of the preferred embodiments, as well as other embodiments of the invention, will be obvious and suggested to those skilled in the art from the disclosure herein, whereby it is to be distinctly understood that the foregoing descriptive matter is to be interpreted merely as illustrative of the present invention and not as a limitation thereof.

What is claimed:

1. A roof edging system configured to be connected to a roof of a building, said roof edging system comprising:

a base anchor configured to be connected to the roof of the building, said base anchor comprising one or more flanges;

a fascia cover configured to engage said base anchor and to provide an aesthetic appearance to said roof edging system, said fascia cover having a first end configured to engage a first portion of said base anchor, and a second end configured to engage a second portion of said base anchor; and, a compression system configured to connect to said base anchor, said compression system including a compression portion formed of a compressible material, said compression system configured to contact said fascia cover and said base anchor and to be partially compressed between said fascia cover and said base anchor and to form a liquid seal between said fascia cover and said base anchor when said fascia cover is connected to said base anchor, at least a portion of said compression system is positioned on a top surface of said base anchor and a portion of said fascia cover and at least a portion of said compressible material is caused to be compressed when said fascia cover is connected to said base anchor, said compressible material of said compression system is configured to compress and deform from a force applied to said compression system by said fascia cover when said fascia cover is connected to said base anchor, said compression system is configured to expand when force from said fascia cover is reduced on said compression system.

2. The roof edging system as defined in claim 1, wherein at least a portion of said base anchor is configured such that at least a portion of said base anchor extends above a top surface of said roof that is located adjacent to said base anchor when said base anchor is connected to said roof, and said compression system located above said top surface of said roof that is located adjacent to said base anchor when said base anchor is connected to said roof and said fascia cover is connected to said base anchor.

3. The roof edging system as defined in claim 1, wherein said compression portion includes at least one cavity configured to facilitate in compression of said compression portion.

4. The roof edging system as defined in claim 1, wherein said compression system includes a compression base that extends downwardly from said compression portion, an outer surface of said compression base includes a plurality of surface projections configured to facilitate in said connection of said compression base to said base anchor.

5. The roof edging system as defined in claim 1, wherein said base anchor further comprises:

a sealing flange, said sealing flange configured to overlie a top surface of said roof when said base anchor is connected to the building;

an engagement flange, said engagement flange configured to engage a rear end of said sealing flange and extending upwardly from said sealing flange, a top end portion of said engagement flange configured to connect to said fascia cover, said compression system configured to be connected to a top surface of said sealing flange; and, a locking flange, said locking flange configured to engage said rear end of said sealing flange and extending downwardly from said sealing flange.

6. The roof edging system as defined in claim 5, wherein said engagement flange comprises:

a first angled portion extending outwardly from said rear end of said sealing flange;

a bottom end of a vertical portion extending upwardly from a top end of said first angled portion;

a first end of a horizontal portion extending approximately perpendicularly from a top end of said vertical portion; and, a second angled portion extending in a downward direction from a second end of said horizontal portion.

7. The roof edging system as defined in claim 6, wherein said horizontal portion includes a slot or groove configured to receive at least a portion of a compression base of said compression system.

8. A roof edging system configured to be connected to a roof of a building, said roof edging system comprises:

a base anchor configured to be connected to the roof of the building, said base anchor comprising one or more flanges;

a fascia cover configured to overlap and engage at least a portion of said base anchor and to provide an aesthetic appearance to said roof edging system, said fascia cover having a first end configured to overlap and engage a first portion of said base anchor, and a second end configured to engage a second portion of said base anchor; and, a compression system configured to connect to said base anchor, said compression system at least partially formed of a polymer material, said compression system including a compression portion formed of a compressible material, said compression system configured to contact said first end of said fascia cover and said base anchor and to be partially compressed between said first end said fascia cover and said base anchor and to form a liquid seal between first end of said fascia cover and said base anchor when said fascia cover is connected to said base anchor, said compressible material of said compression system is configured to compress and deform from a force applied to said compression system by said fascia cover when said fascia cover is connected to said base anchor, said compression system is configured to expand when force from said fascia cover is reduced on said compression system.

9. The roof edging system as defined in claim 8, wherein said polymer material includes rubber, plastic, polyurethane, polyvinyl chloride (PVC), polyethylene, and/or polystyrene.

10. The roof edging system as defined in claim 8, wherein said base anchor further comprises:

a sealing flange, said sealing flange configured to overlie a top surface of said roof when said base anchor is connected to the building;

an engagement flange, said engagement flange configured to engage a rear end of said sealing flange and extending upwardly from said sealing flange, a top end portion of said engagement flange configured to connect to said fascia cover, said compression system configured to be connected to a top surface of said sealing flange; and, a locking flange, said locking flange configured to engage said rear end of said sealing flange and extending downwardly from said sealing flange.

11. The roof edging system as defined in claim 10, wherein said engagement flange comprises:

a first angled portion extending outwardly from said rear end of said sealing flange;

a bottom end of a vertical portion extending upwardly from a top end of said first angled portion;

a first end of a horizontal portion extending approximately perpendicularly said top end of said vertical portion; and, a second angled portion extending in a downward direction from a second end of said horizontal portion.

12. The roof edging system as defined in claim 11, wherein said horizontal portion includes a slot or groove configured to receive at least a portion of a compression base of said compression system.

13. A roof edging system configured to be connected to a roof of a building, said roof edging system comprises:

a base anchor configured to be connected to the roof of the building, said base anchor comprising one or more flanges;

a fascia cover configured to overlap and engage at least a portion of said base anchor and to provide an aesthetic appearance to said roof edging system, said fascia cover having a first end configured to overlap and engage a first portion of said base anchor, and a second end configured to engage a second portion of said base anchor; and, a compression system configured to connect to said base anchor, said compression system at least partially formed of a polymer material, said compression system including a compression portion formed of a compressible material, said compression system configured to contact said first end of said fascia cover and said base anchor and to be partially compressed between said first end of said fascia cover and said base anchor and to form a liquid seal between first end of said fascia cover and said base anchor when said fascia cover is connected to said base anchor, said compression system includes a compression base that extends downwardly from said compression portion, an outer surface of said compression base includes a plurality of surface projections configured to facilitate in said connection of said compression base to said base anchor.

* * * * *